US009728174B2

(12) United States Patent
Haddad

(10) Patent No.: US 9,728,174 B2
(45) Date of Patent: Aug. 8, 2017

(54) OPTOELECTRONIC PICKUP FOR MUSICAL INSTRUMENTS

(71) Applicant: Light4Sound, San Francisco, CA (US)

(72) Inventor: Waleed Sami Haddad, San Francisco, CA (US)

(73) Assignee: LIGHT4SOUND, San Francisco, CA (US)

( * ) Notice: Subject to any disclaimer, the term of this patent is extended or adjusted under 35 U.S.C. 154(b) by 0 days.

(21) Appl. No.: 14/816,317

(22) Filed: Aug. 3, 2015

(65) Prior Publication Data

US 2016/0035333 A1 Feb. 4, 2016

Related U.S. Application Data

(63) Continuation of application No. 14/326,118, filed on Jul. 8, 2014, now Pat. No. 9,099,068, which is a continuation of application No. 14/010,901, filed on Aug. 27, 2013, now Pat. No. 8,772,609, which is a continuation of application No. 13/423,060, filed on Mar. 16, 2012, now Pat. No. 8,519,252.

(60) Provisional application No. 61/453,377, filed on Mar. 16, 2011.

(51) Int. Cl.

| | |
|---|---|
| ***G10H 3/06*** | (2006.01) |
| ***G10H 1/055*** | (2006.01) |
| ***G10H 3/18*** | (2006.01) |

(52) U.S. Cl.

CPC ..... *G10H 3/06* (2013.01); *G10H 1/0553* (2013.01); *G10H 3/18* (2013.01); *G10H 2220/411* (2013.01)

(58) Field of Classification Search

CPC ..... G10H 3/06; G10H 3/18
USPC ..... 84/724
See application file for complete search history.

(56) References Cited

U.S. PATENT DOCUMENTS 2,039,659 A * 5/1936 Ranger ..... G10H 3/06 250/230
2,666,650 A * 1/1954 MacDonell ..... G11B 7/00 181/157
2,933,967 A * 4/1960 Riscol ..... G10H 3/181 84/726
3,405,222 A * 10/1968 Heinzl ..... G10H 3/06 84/718
3,662,081 A * 5/1972 Hale ..... G10G 7/00 84/477 B
3,733,953 A * 5/1973 Ferber ..... G10H 3/181 84/724
4,003,284 A * 1/1977 Marsh, II ..... G10H 5/16 84/639
4,018,448 A * 4/1977 Di Matteo ..... G10H 3/06 369/275.3
4,028,977 A * 6/1977 Ryeczek ..... G10D 1/085 398/132
4,362,934 A 12/1982 McLey
4,429,607 A 2/1984 Meno
4,442,750 A * 4/1984 Bowley ..... G10H 1/0033 250/227.19
4,468,999 A * 9/1984 Bonanno ..... G10H 1/46 341/31
4,563,931 A * 1/1986 Siebeneiker ..... G10D 1/085 73/651
4,688,460 A * 8/1987 McCoy ..... G10H 3/181 84/724
4,730,530 A * 3/1988 Bonanno ..... G10H 3/18 84/724
4,790,230 A 12/1988 Sanderson
4,815,353 A * 3/1989 Christian ..... G10H 3/181 84/724
4,928,563 A * 5/1990 Murata ..... G10G 7/02 324/76.48
4,979,422 A * 12/1990 Belli ..... G10D 13/027 359/1

(Continued)

FOREIGN PATENT DOCUMENTS

| | | |
|---|---|---|
| EP | 0545918 | 2/1996 |
| KR | 1020060072877 | 6/2006 |

OTHER PUBLICATIONS

US 5,877,442, 03/1999, Freeland et al. (withdrawn)

(Continued)

*Primary Examiner* — David Warren
(74) *Attorney, Agent, or Firm* — Hollingsworth Davis, LLC

(57) ABSTRACT

An optoelectronic pickup for a musical instrument includes at least one light source which directs light to impinge a sound generating element of the musical instrument in at least one photoreceiver located to detect the reflected light, (Continued)

so as to generate an electrical signal that is responsive to sound generating element movement.

20 Claims, 15 Drawing Sheets

(56) References Cited

U.S. PATENT DOCUMENTS 4,995,292 A * 2/1991 Nomura ..... G10H 3/181 84/726
5,012,086 A * 4/1991 Barnard ..... G01V 8/20 250/222.1
5,014,588 A * 5/1991 Omata ..... G10H 3/181 84/726
5,117,730 A * 6/1992 Yamauchi ..... G10H 1/055 84/723
5,206,449 A * 4/1993 McClish ..... G10H 3/182 84/723
5,214,232 A * 5/1993 Iijima ..... G10H 1/0553 84/723
5,237,123 A 8/1993 Miller
5,237,126 A * 8/1993 Curtis ..... G01V 8/20 250/222.1
5,291,011 A 3/1994 Mantani
5,408,911 A * 4/1995 Weiss ..... G10H 1/0008 84/199
5,524,521 A 6/1996 Clift et al.
5,612,502 A 3/1997 Ura
5,641,925 A 6/1997 Koseki
5,824,930 A 10/1998 Ura et al.
5,834,669 A 11/1998 Clift et al.
5,905,220 A 5/1999 Lee et al.
5,913,260 A * 6/1999 Buchla ..... G01H 9/00 250/206.1
5,977,467 A 11/1999 Freeland et al.
6,153,822 A * 11/2000 Toba ..... G10H 1/00 84/724
6,175,074 B1 * 1/2001 Takahashi ..... G10H 1/0008 84/724
6,229,081 B1 5/2001 Ura et al.
6,297,437 B1 10/2001 Ura et al.
6,359,207 B1 3/2002 Oba et al.
6,403,872 B2 6/2002 Muramatsu et al.
6,489,550 B1 * 12/2002 Takahashi ..... G10H 1/00 84/724
6,501,012 B1 * 12/2002 Toba ..... G10H 1/00 341/31
6,712,323 B1 3/2004 Cheung et al.
6,740,803 B2 5/2004 Brinkman et al.
6,933,435 B2 8/2005 Kato et al.
7,049,576 B2 5/2006 Kato et al.
7,060,887 B2 6/2006 Pangrie
7,116,849 B2 10/2006 Kato
7,132,643 B2 * 11/2006 Kato ..... G10F 1/02 250/221
7,161,137 B2 1/2007 Ura et al.
7,186,967 B2 3/2007 Kato
7,223,913 B2 * 5/2007 Knapp ..... G09B 5/065 84/462
7,271,328 B2 9/2007 Pangrie
7,297,864 B2 * 11/2007 Ueshima ..... A63F 13/00 345/184
7,411,124 B2 8/2008 Maramatsu
7,432,431 B2 10/2008 Hirota et al.
7,446,253 B2 * 11/2008 Knapp ..... G09B 5/065 84/645
7,504,578 B2 3/2009 Lewry
7,589,273 B2 9/2009 Uehara
7,642,448 B2 1/2010 Kato
7,711,442 B2 5/2010 Ryle et al.
7,812,244 B2 * 10/2010 Kotton ..... G10H 3/06 84/615
7,843,575 B1 11/2010 Starkey
7,897,866 B2 * 3/2011 Sullivan ..... G10H 1/342 84/440
7,902,448 B2 3/2011 Kikumoto et al.
7,960,640 B2 6/2011 Ludwig
7,977,566 B2 * 7/2011 Haddad ..... G10H 3/06 84/724
8,013,234 B1 9/2011 Starkey
8,022,288 B2 * 9/2011 Sullivan ..... G10H 1/342 84/615
8,173,887 B2 * 5/2012 Sullivan ..... G10H 1/342 84/724
8,242,346 B2 * 8/2012 Haddad ..... G10H 3/06 84/724
8,431,814 B2 * 4/2013 Wessels ..... G10H 1/0553 84/724
8,509,692 B2 8/2013 Ryle et al.
8,519,252 B2 8/2013 Haddad
8,546,677 B2 10/2013 Haddad
8,569,608 B2 * 10/2013 Moon ..... G10H 1/0553 84/264
8,772,619 B2 * 7/2014 Haddad ..... G10H 3/06 84/724
8,785,758 B2 7/2014 Wissmuller
9,047,851 B2 * 6/2015 Haddad ..... G10H 3/06
9,082,383 B2 7/2015 Haddad
2001/0003945 A1 6/2001 Muramatsu et al.
2002/0059862 A1 5/2002 Muramatsu et al.
2003/0070526 A1 4/2003 Muramatsu et al.
2003/0177894 A1 9/2003 Skinn
2004/0003708 A1 * 1/2004 Buchla ..... G10H 1/0553 84/724
2004/0099131 A1 5/2004 Ludwig
2004/0221711 A1 * 11/2004 Kato ..... G10G 3/04 84/724
2005/0061959 A1 3/2005 Kato
2005/0077453 A1 * 4/2005 Kato ..... G10H 1/0553 250/221
2006/0011048 A1 1/2006 Koster
2006/0107826 A1 * 5/2006 Knapp ..... G09B 5/065 84/724
2006/0162534 A1 7/2006 Muramatsu
2006/0174756 A1 8/2006 Pangrie
2006/0207413 A1 9/2006 Tisserand
2006/0213358 A1 * 9/2006 Motsenbocker ..... G10H 3/185 84/731
2007/0256551 A1 * 11/2007 Knapp ..... G09B 5/065 84/722
2008/0011151 A1 * 1/2008 Kato ..... G01D 5/30 84/724
2008/0229907 A1 9/2008 Clark
2008/0282873 A1 * 11/2008 Kotton ..... G10H 3/06 84/645
2009/0100993 A1 4/2009 Komatsu
2009/0151548 A1 6/2009 Kikumoto et al.
2009/0178547 A1 7/2009 Hirano
2009/0211431 A1 8/2009 Zhang et al.
2010/0011942 A1 * 1/2010 Wessels ..... G10H 1/0553 84/724
2010/0154620 A1 * 6/2010 Loock ..... G01H 9/004 84/724
2010/0313740 A1 12/2010 Ryle et al.
2011/0061517 A1 * 3/2011 Haddad ..... G10H 3/06 84/724
2011/0132180 A1 * 6/2011 Gobbers ..... G10H 1/14 84/622
2011/0265635 A1 * 11/2011 Haddad ..... G10H 3/06 84/724
2012/0234161 A1 * 9/2012 Haddad ..... G10H 3/06 84/724
2012/0266740 A1 10/2012 Hilbish et al.
2012/0272813 A1 11/2012 Moon
2012/0304848 A1 12/2012 Haddad
2014/0026739 A1 1/2014 Haddad
2014/0076127 A1 3/2014 Haddad
2014/0318349 A1 10/2014 Haddad

(56) References Cited

U.S. PATENT DOCUMENTS

| | | | | |
|---|---|---|---|---|
| 2015/0122112 | A1* | 5/2015 | Prichard | G10G 3/04 84/724 |
| 2015/0379974 | A9* | 12/2015 | Wang | G10H 1/0008 84/609 |
| 2016/0035333 | A1* | 2/2016 | Haddad | G10H 3/06 84/724 |

OTHER PUBLICATIONS

File history for U.S. Appl. No. 12/561,409.
File history for U.S. Appl. No. 13/181,180.
File history for U.S. Appl. No. 13/585,488.
File history for U.S. Appl. No. 14/043,103.
File history for U.S. Appl. No. 13/423,060.
File history for U.S. Appl. No. 14/010,901.
File history for U.S. Appl. No. 14/326,118.
International Search Report and Written Opinion dated Apr. 25, 2011 from PCT Application No. PCT/US2010/049254, 8 pages.
International Preliminary Report on Patentability dated Mar. 20, 2012 from PCT Application No. PCT/US2010/049254, 4 pages.

* cited by examiner

OPTOELECTRONIC PICKUP FOR MUSICAL INSTRUMENTS

RELATED PATENT DOCUMENTS

This application is a continuation of U.S. Ser. No. 14/326,118, filed Jul. 8, 2014, which is a continuation of U.S. Ser. No. 14/010,901 filed Aug. 27, 2013, now U.S. Pat. No. 8,772,619, which is a continuation of U.S. Ser. No. 13/423,060, filed Mar. 16, 2012, now U.S. Pat. No. 8,519,252, which claims the benefit of Provisional Patent Application Ser. No. 61/453,377, filed on Mar. 16, 2011, to which priority is claimed pursuant to 35 U.S.C. §119(e) and which are hereby incorporated herein by reference.

SUMMARY

Embodiments of the disclosure are directed to an optoelectronic pickup of a musical instrument which includes at least one light source positioned to direct light to impinge a sound producing element of the musical instrument, and at least one photoreceiver positioned relative to the at least one light source to detect reflected light from the sound producing element. The pickup is configured to measure a position of the sound producing element using a characteristic of a beam pattern produced by the at least one light source. The beam pattern characteristic may comprise an intensity, spectral characteristic, a color, or modulation frequency of the beam pattern.

Other embodiments are directed to an optoelectronic pickup of a musical instrument which includes a plurality of light sources positioned to direct light to impinge one or more sound producing elements of the musical instrument, the plurality of light sources producing overlapping beam patterns. At least one photoreceiver is positioned relative to the plurality of light sources to detect reflected light from the one or more sound producing elements. The pickup is configured to measure a position of the one or more sound producing elements using a characteristic of the beam patterns.

Embodiments of the disclosure are also directed to an optoelectronic pickup of a musical instrument which includes at least one light source positioned to direct light to impinge a sound producing element of the musical instrument. At least one photoreceiver is positioned relative to the at least one light source to detect reflected light from the sound producing element. The pickup is configured to measure a position of the sound producing element in each of a first plane and a second plane through which the sound producing element moves using a signal indicative of the detected reflected light, and to generate an electrical signal indicative of sound producing element position during play. The pickup may be configured to measure sound producing element position in the first plane using a first mechanism, and measure sound producing element position in the second plane using a second mechanism differing from the first mechanism.

In some embodiments, an optoelectronic pickup of a musical instrument includes at least one light source positioned to direct light to impinge a sound producing element of the musical instrument, and at least one photoreceiver positioned relative to the at least one light source to detect reflected light from the sound producing element. The pickup uses variation of light intensity through patterned illumination in a reflection mode to measure the position of the sound producing element moving in both horizontal and vertical dimensions during play.

According to other embodiments, an optoelectronic pickup of a musical instrument includes at least one light source positioned to direct light to impinge a sound producing element of the musical instrument, and at least two photoreceivers positioned relative to the at least one light source to detect reflected light from the sound producing element. The pickup uses bi-wavelength patterning with two different wavelength-specific photoreceivers to measure the position of the sound producing element during play.

In further embodiments, an optoelectronic pickup of a musical instrument includes one or more light sources positioned to direct light to impinge one or more sound producing element of the musical instrument, and at least one photoreceiver positioned relative to the one or more light sources to detect reflected light from the one or more sound producing elements. The pickup uses two different illuminator modulation frequencies to measure the position of the sound producing element during play.

In accordance with various embodiments, an optoelectronic pickup of a musical instrument includes at least one light source positioned to direct light to impinge a sound producing element of the musical instrument, and at least one photoreceiver positioned relative to the at least one light source to detect reflected light from the sound producing element. The pickup uses one or more of lenses, filters, diffractive optics, or baffles to shape the light beam, thereby changing an output waveform as the sound producing element vibrates.

According to other embodiments, an optoelectronic pickup of a musical instrument includes one or more light sources positioned to direct light to impinge one or more sound producing element of the musical instrument, and at least one wavelength-sensitive sensor positioned relative to the one or more light sources to detect reflected light from the one or more sound producing elements. The pickup uses spectral patterning and the wavelength-sensitive sensor to produce an output signal during play.

In some embodiments, an optoelectronic pickup of a musical instrument includes one or more light sources positioned to direct light to impinge one or more sound producing element of the musical instrument, and at least one wavelength-sensitive sensor positioned relative to the one or more light sources to detect reflected light from the one or more sound producing elements. The pickup causes a light beam to vary in color as a function of angle off axis of the light source during play.

In various embodiments, an optoelectronic pickup of a musical instrument includes one or more light sources positioned to direct light to impinge one or more sound producing element of the musical instrument, and at least one wavelength-sensitive sensor positioned relative to the one or more light sources to detect reflected light from the one or more sound producing elements. A beam shaping element is configured to change an intensity profile of the one or more light sources to produce a non-sinusoidal waveform in response to movement of the sound producing element.

In accordance with further embodiments, an optoelectronic pickup of a musical instrument includes one or more light sources positioned to direct light to impinge one or more sound producing element of the musical instrument, and at least one photoreceiver positioned relative to the one or more light sources to detect reflected light from the one or more sound producing elements. The pickup uses one light source for each sound producing element to measure the position of the one or more sound producing elements during play.

In other embodiments, an optoelectronic pickup of a musical instrument includes one or more light sources positioned to direct light to impinge one or more sound producing element of the musical instrument, and at least one photoreceiver positioned relative to the one or more light sources to detect reflected light from the one or more sound producing elements. The pickup uses an array of light sources for each sound producing element to measure the position of the one or more sound producing elements during play.

In various embodiments, an optoelectronic pickup of a musical instrument includes one or more light sources positioned to direct light to impinge one or more sound producing element of the musical instrument, and at least one photoreceiver positioned relative to the one or more light sources to detect reflected light from the one or more sound producing elements. The pickup uses one light source to measure the position of two or more sound producing elements during play.

According to some embodiments, an apparatus of a string musical instrument includes an optoelectronic pickup of a musical instrument including one or more light sources positioned to direct light to impinge one or more sound producing element of the musical instrument, and at least one photoreceiver positioned relative to the one or more light sources to detect reflected light from the one or more sound producing elements. A string is adapted for use with the pickup, and includes one or more features applied to or incorporated into the string that enhance an optical response to string movement during play by the optoelectronic pickup.

In other embodiments, an optoelectronic pickup of a musical instrument includes two light sources positioned to direct light to impinge a single sound producing element of the musical instrument, and two photoreceivers positioned relative to the two light sources to detect reflected light from the single sound producing elements. The pickup uses a differential signal from the two photoreceivers to produce an output signal during play.

In some embodiments, an apparatus includes a string adapted for use with a musical instrument, and one or more features applied to or incorporated into the string that enhance an optical response to string movement by an optoelectronic pickup during play.

These and other features can be understood in view of the following detailed discussion and the accompanying drawings.

DESCRIPTION

Figure 1:
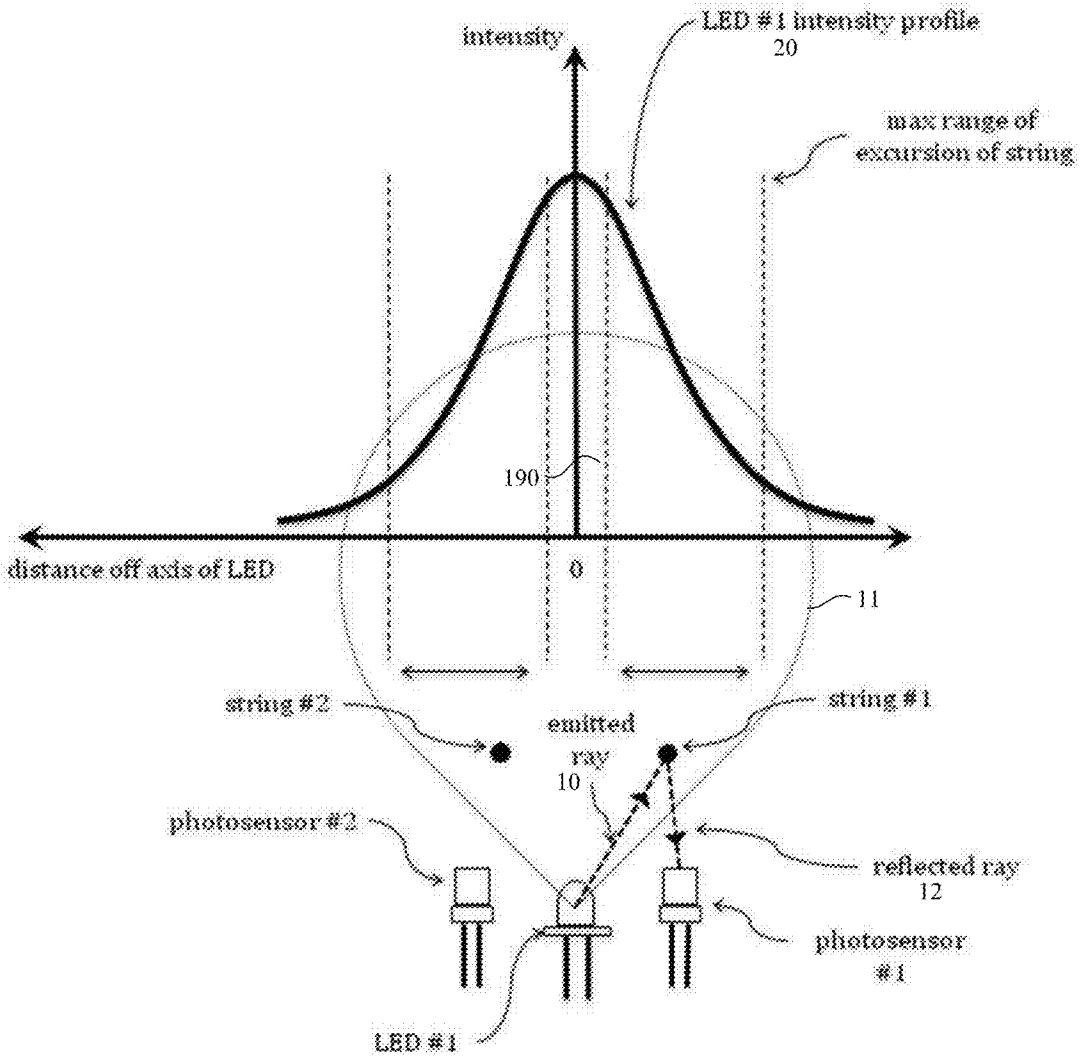
FIG. 1 illustrates an optical framework for a representative optoelectronic pickup and a diagram showing how an optoelectronic pickup measures the position of a guitar string in the horizontal direction in accordance with various embodiments.

Embodiments of the disclosure relate to a pickup for musical instruments having one or more sound producing elements. More particularly, the present disclosure relates to a pickup apparatus for musical instruments that employs optical components to discern the position of a sound producing element or elements during play, thereby providing enhanced sound generation and enabling other features. Embodiments disclosed herein are generally directed to string instruments (e.g., a guitar), it being understood that embodiments are contemplated for instruments that use different sound generating elements and mechanisms (e.g., instruments with a single-reed or double-reeds, resonating tubes, resonating bars, membranes or membranous elements).

A traditional electric guitar pickup utilizes magnets and a wire coil to produce sound. It also requires the guitar strings to be made of a ferro-metal. When the ferro-metal strings of the guitar are strummed within the magnetic field produced by the fixed magnets of the pickup, a time-varying voltage is induced in the coil. This time-varying voltage can then be amplified to produce sound. The voltage represents the speed of an instrument string as it vibrates. While this configuration is sufficient to produce sound, it includes limitations with respect to accurately representing the string vibrations, and does not provide the musician with much control of the sound. Furthermore, magnetic pickups can be susceptible to interference from other magnetic or electronic sources, which can diminish sound quality.

An optoelectronic pickup of a musical instrument in accordance with embodiments of the disclosure includes at least one light source positioned to direct light to impinge a sound producing element of the musical instrument and at least one photoreceiver located to detect reflected light from the sound producing element so as to generate an electrical signal that is responsive to the detection of reflected light. Embodiments are directed to an optoelectronic pickup apparatus that can enable precise play and enable sound enhancement and adjustment. Embodiments include an optoelectronic pickup apparatus that can be installed on an existing instrument.

According to some embodiments, an optoelectronic pickup apparatus that uses variation of light intensity through patterned illumination in a reflection mode to measure the position of a moving string in both horizontal and vertical dimensions. For example, an optoelectronic pickup of a string musical instrument preferably includes at least one light source positioned to direct light to impinge an instrument string of the musical instrument. At least one photoreceiver is positioned relative to the at least one light source to detect reflected light from the string. The pickup is configured to measure a position of the string in each of a first plane and a second plane through which the string moves using a signal indicative of the detected reflected light. The first plane is preferably orthogonal to the second plane. The pickup is configured to generate an electrical signal indicative of string position.

The pickup may be configured to measure string position in the first plane using a first mechanism, and measure string position in the second plane using a second mechanism differing from the first mechanism. The pickup may combine signals indicative of string position measured in the first and second planes, and generate an electrical signal indicative of the combined signals.

Other embodiments include an optoelectronic pickup apparatus that uses bi-wavelength patterning with two different wavelength-specific photosensors instead of straight intensity patterning. Some optoelectronic pickup embodiments use two different illuminator modulation frequencies instead of straight intensity patterning. Other optoelectronic pickup embodiments use optical components such as lenses, filters, diffractive optics, or baffles, etc. to shape the beam, thereby changing the output waveform as the sound producing element, such as a string, vibrates.

In further embodiments, an optoelectronic pickup apparatus uses spectral patterning (causing the beam to vary in color as a function of angle off axis of the light source) and a wavelength-sensitive sensor instead of straight intensity patterning. Still other embodiments of an optoelectronic pickup apparatus use different LED (light emitting diode) configurations, in particular, one which has one LED per string, instead of one LED for each pair of strings. According to some embodiments, an optoelectronic pickup apparatus uses an array of LEDs for each string or group of strings such that the beam pattern illuminating the strings can be adjusted electronically, and programmed (if desired) with different preset illumination patterns to change the sound of the instrument. In various embodiments, a beam shaping element (e.g., optic) is incorporated into the pickup to change the LED intensity profile, which produces a waveform other than a sinusoid in response to the movement of the string(s).

Further embodiments are directed to instrument strings designed for use with an optoelectronic pickup. Such strings are referred to herein as "optical strings," in that the optical strings include one or more features that enhance sound generation when used in conjunction with an optoelectronic pickup. Optical strings may include one or more of special reflective coatings, special strings with polished sections in the illuminated region, strings made of special materials other than those commonly in use, and strings having varied cross-sectional geometries, in addition to circular cross-sections. Various embodiments of optical strings can be tailored for different types of playing, and can take advantage of the fact that the optoelectronic pickup does not require ferro-metal strings. It is understood that embodiments are directed to optical strings alone or in combination with an optoelectronic pickup apparatus.

In accordance with some embodiments, the separation and use of the very-low frequency information related to the average position of the string that is available with the optoelectronic pickup may advantageously be used as a control signal to affect the sound during play. In other embodiments, a MIDI (Musical Instrument Digital Interface) signal output may be provided on the optoelectronic pickup.

Embodiments of optoelectronic pickups described herein measure the position of the sound producing element or elements of a musical instrument as it vibrates, and is very sensitive to even small changes in position. The measurement of the position (e.g., 2-dimensional position) is converted into a voltage by either analog or digital electronics that are part of the pickup design. Some embodiments perform this conversion using analog electronics, and is preferred because of its simplicity and more natural sound. An optoelectronic pickup of the disclosure is different from a standard magnetic pickup, because the magnetic pickup relies on the fact that an EMF can be generated in a wire coil by time variations in the magnetic field, and therefore the voltage caused by the EMF is actually related to the speed of motion of a ferro-metal string (or other metal object) within the magnetic field.

A vibrating guitar string, for example, generally oscillates in two dimensions, not simply back and forth within a single plane. For purposes of explanation and not of limitation, we refer to the horizontal and vertical directions of motion, with the horizontal direction being in the plane of the set of strings, and parallel to the top of the guitar, and perpendicular to the axis of the guitar neck, while the vertical direction is perpendicular to the horizontal direction. Optoelectronic pickups described herein are sensitive to the position of the string in both directions, but the mechanisms by which the positions are measured by circuitry of the optoelectronic pickups in the two directions are different.

Details of an optical framework for a representative optoelectronic pickup and a diagram showing how an embodiment of the optoelectronic pickup measures the position of the guitar string in the horizontal direction are presented in FIG. 1. According to various embodiments, three LEDs are used for a six-string guitar, with one LED used to illuminate two strings. In the configuration shown in FIG. 1, LED #1 is arranged to illuminate string #1 and string #2. This design takes advantage of the natural beam pattern 11 of the LEDs. There is one photosensor for each string, shown as photosensor #1 associated with string #1 and photosensor #2 associated with string #2. At rest, each string #1 and #2 is located in a wing of an LED beam pattern 11, such that the beam is brighter to one side of the string, and dimmer to the other.

In FIG. 1, string #2 is positioned to the left of, and above, LED #1, and the beam profile 11 of LED #1 is shown above, while the range of horizontal motion is delineated by the two vertical dotted lines. Photosensor #2, which is the designated detector for light reflected from string #2, is spaced to the left of string #2, and below it. In some embodiments, the LEDs may be separated from the photosensors by a distance of about 3 cm in the direction of the length of the strings, and are angled towards each other so as to concentrate their focus on the same point on the bottom surface of the string, such that the light from LED #1 impinges on and is reflected from string #2 and collected by the photosensor #2, for example.

When a string is in its resting position, an amount of light, call it L0, is collected by the photosensor. In the horizontal direction, if string #2 moves to the right of its resting position, for example, string #2 will be exposed to more light as it gets closer to the central axis of LED #1, and thus photosensor #2 will receive more reflected light. If string #2 moves to the left of its resting position, photosensor #2 will receive less light reflected from string #2. The light received by photosensor #2 is converted to a voltage, and this signal can be amplified. It is understood that the scenario described above with regard to string #2 and photosensor #2 applies to string #1 and photosensor #1 as string #1 moves left (closer to LED #1) and right (away from LED #1) of its resting position, respectively.

Depending on the beam profile of the LED, the voltage output may not be a linear function of the position of the string. This may or may not be desirable, and optical filters, concentrators (such as lenses), diffractive elements (such as gratings, holographic filters, Fresnel lenses, etc.), baffles, and other optical elements can be used to shape the beam profile of the LEDs at the string surface as needed or desired.

Figure 2:
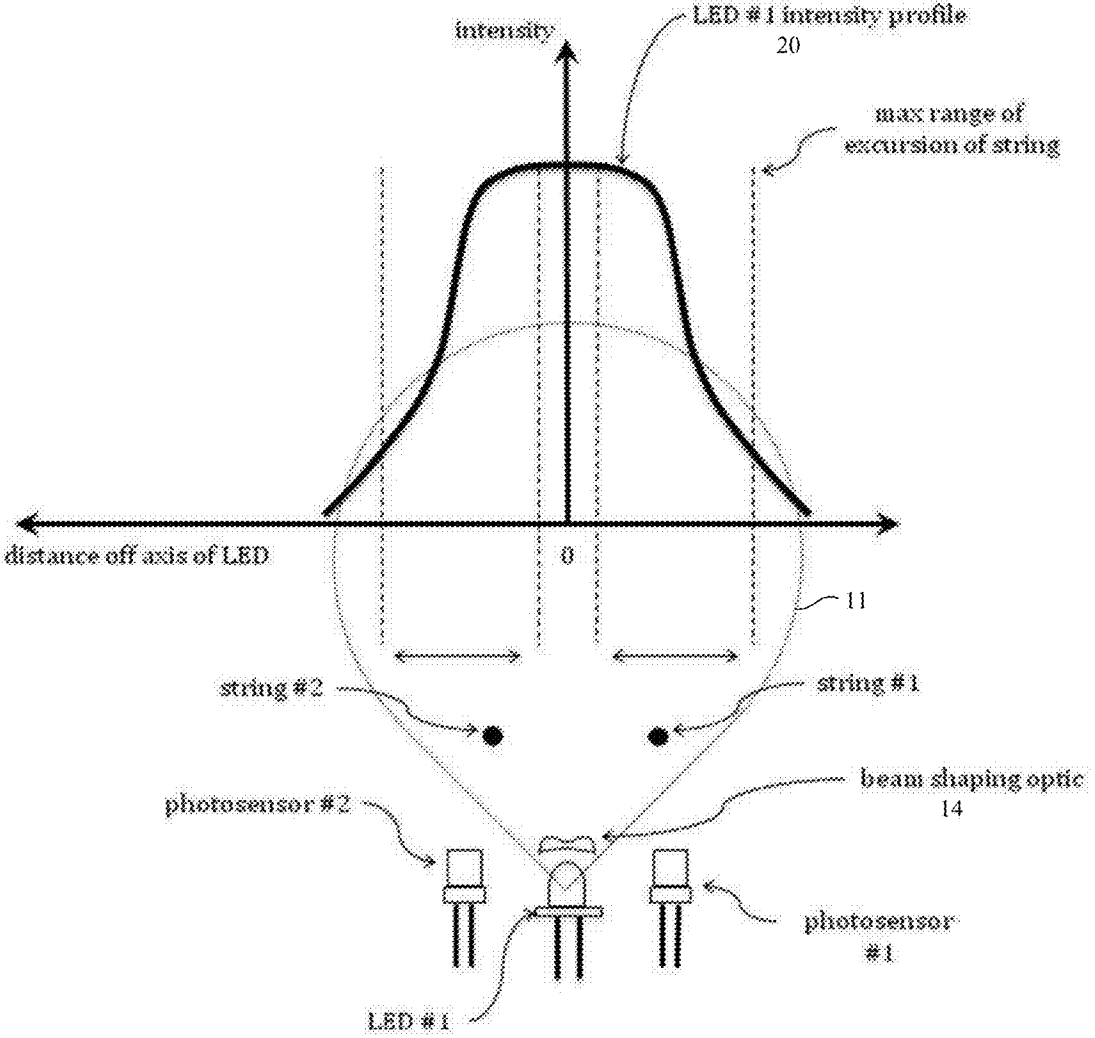
FIG. 2 shows the addition of a beam shaping optic to the arrangement illustrated in FIG. 1, which changes the LED intensity profile and produces a waveform other than a sinusoid in response to the movement of the string in accordance with various embodiments.

FIG. 2 shows the addition of a beam shaping optic 14 that changes the LED intensity profile 11 and which produces a waveform other than a sinusoid in response to the movement of the string. Since string #1 is in the opposite wing of LED #1, all will be the same as described in FIG. 1 above, except that the signal will be of opposite phase, since the brightness at the string plane is decreasing to the right in the case of string #1. A non-sinusoidal waveform produced from use of the beam shaping optic 14 shown in FIG. 2 can be processed in a manner described herein to generate an electrical signal indicative of string position during play.

Figure 3:
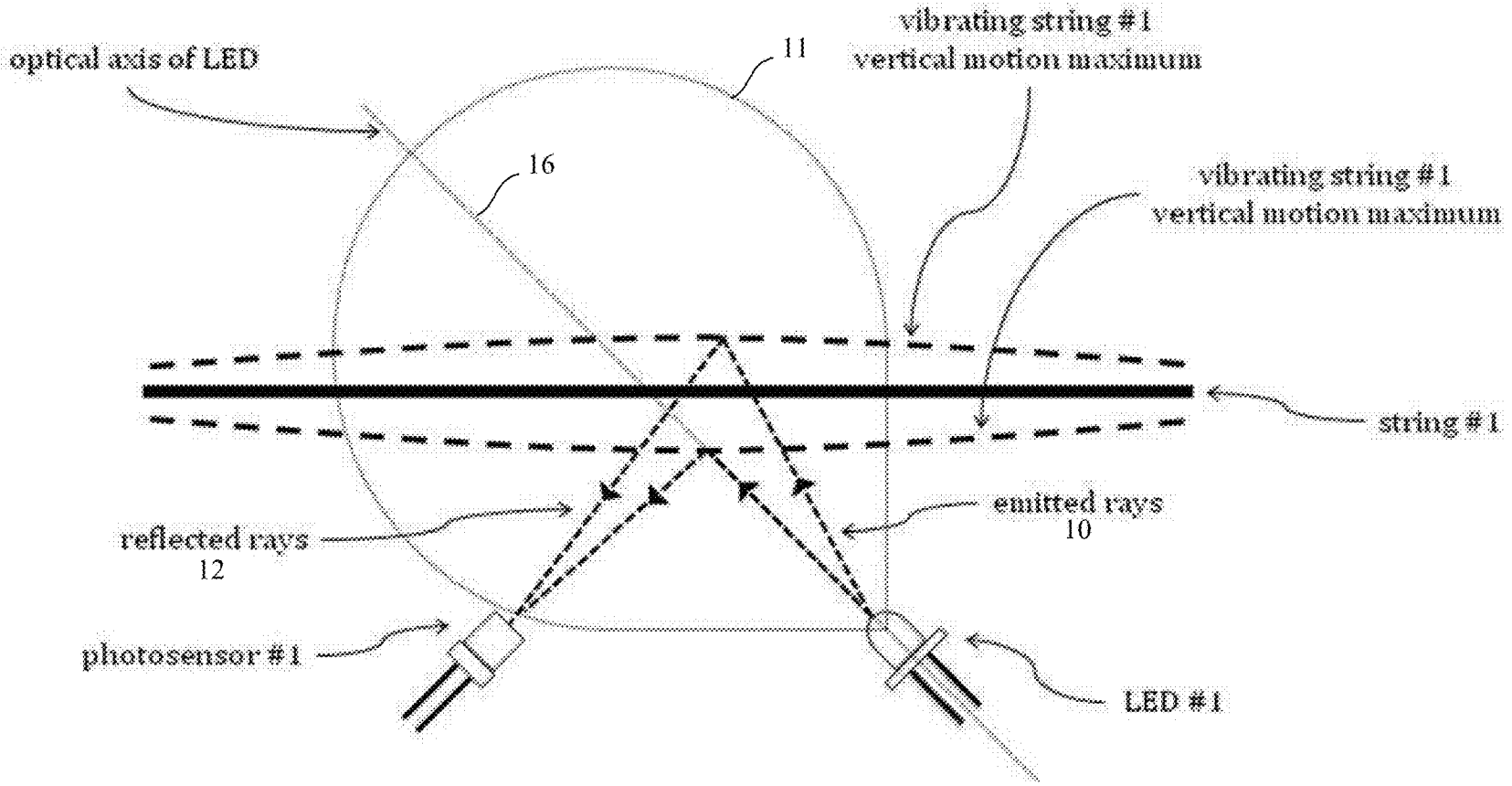
FIG. 3 shows how an optoelectronic pickup measures motion of a string in the vertical direction in accordance with various embodiments.

FIG. 3 shows how the optoelectronic pickup measures motion of a string in the vertical direction. As mentioned above, LED #1 and photosensor #1 are preferably separated by the width of the pickup, which, in the some embodiments, is in the form factor of a standard "humbucker," so the separation is approximately 3 cm. LED #1 and photosensor #1 are also angled towards each other, as shown. Output from LED #1 is strongest on the optical axis 16, and drops off with both radial distance away from LED #1, and angular position off axis.

When the pickup is positioned properly, string #1, at one vertical extreme (in FIG. 3 this is at its minimum) will be positioned so as to reflect the most light towards photosensor #1 because the reflection point will be closest to, and on axis of LED #1. When string #1 is at its other vertical extreme (the maximum in FIG. 3), the least light will be reflected towards photosensor #1 because string #1 will be further away, and off axis of LED #1. At any location in between the two extremes, the reflected light will be a representation of the vertical position of string #1.

As is the case for the horizontal motion, the exact waveform of the signal at photosensor #1 due to the motion of string #1 will depend on the shape of the LED beam pattern, which, as mentioned above, can be controlled by means of one or more of an optical filter, lens, diffractive element, or baffle, etc. In its simplest form (the current embodiment), since both the horizontal and vertical motion produce changes in the intensity of the reflected light, the two signals are naturally combined as a composite intensity variation without the need for any special electronics or other hardware.

Figure 4:
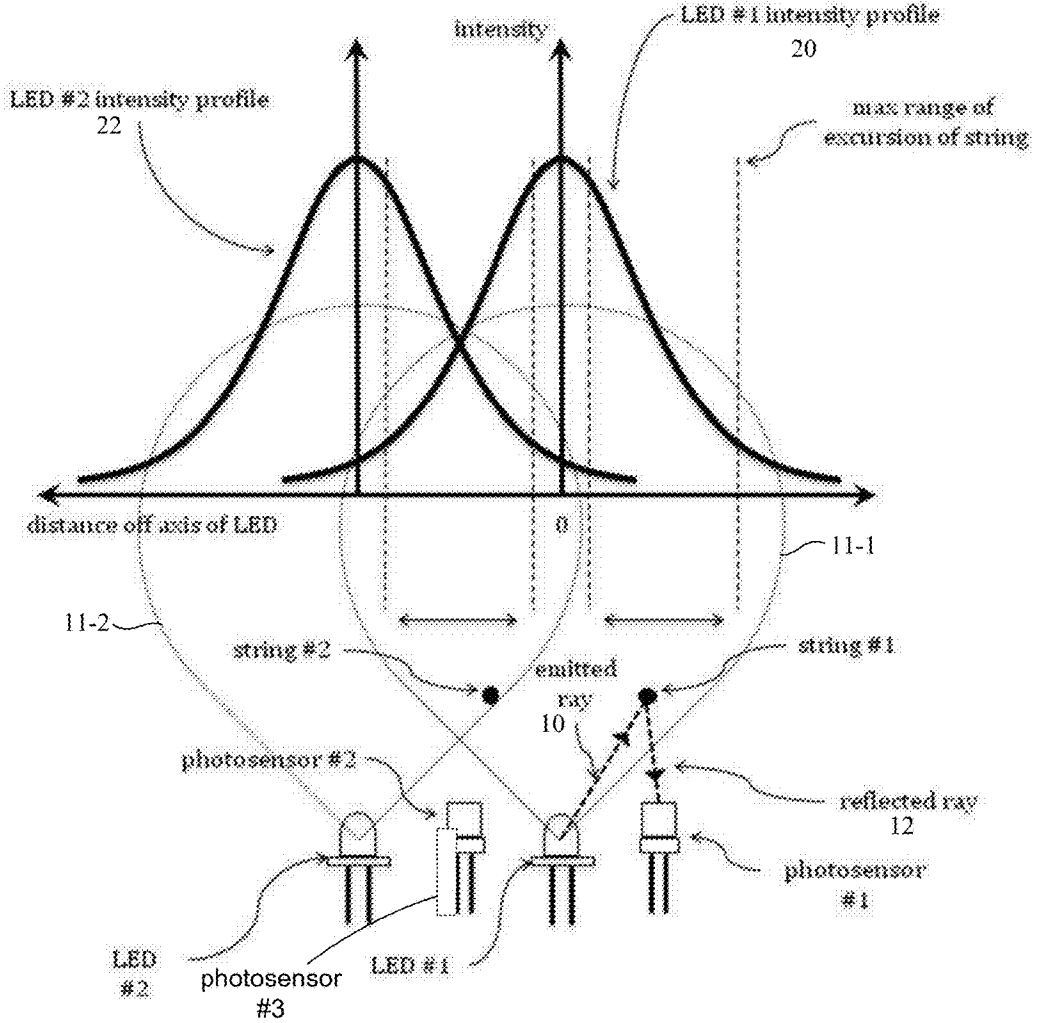
FIG. 4 illustrates an optical framework for a representative optoelectronic pickup and a diagram showing how an optoelectronic pickup measures the position of a guitar string in the horizontal direction using a multiplicity of LEDs having overlapping beam patterns and intensity profiles in accordance with various embodiments.

While some embodiments rely on intensity variation of the reflected light as a function of the string position as described above, other embodiments use the same approach of patterned illumination, but rely on other parameters, such as wavelength, or modulation frequency. An example of this is shown in FIG. 4. In the embodiment depicted in FIG. 4, the setup is essentially the same as that in FIG. 1, but with the addition of a second LED (LED #2) which is located to the left of photosensor #2.

There are several ways to use this second LED. The first is a wavelength dependent variation that can be created if the output wavelength of LED #2 is different from that of LED #1. A second photosensor, shown in phantom as photosensor #3 behind photosensor #2, is also used, and is collocated with photosensor #2. The two photosensors #2 and #3 are wavelength selective, and tuned, one each, to the different wavelengths of the LEDs #1 and #2. It is noted that there would be a corresponding photosensor for LED #1 as well (e.g., a wavelength-selective pair of photoreceivers). The beam patterns 11-1 and 11-2 of the LEDs #1 and #2, respectively, are such that they overlap as shown in FIG. 4, and the beam profiles 20 and 22 overlap as well, crossing roughly at their half maxima points, as shown. This way, the overall intensity reaching the string will be approximately constant as a function of its position in the horizontal direction, but the ratio of the amounts of reflected light at the two wavelengths will vary as a function of the string position. Since collocated photosensors #2 and #3 are wavelength selective, the signals they will produce will be independent of each other, and will vary oppositely as the string moves. Analog or digital electronics can then be used to convert the ratio of the two signals into a time varying voltage that represents the string motion.

Another approach to using a dual-LED configuration described above is to combine such a configuration with super-sonic modulation of the LED's illumination. This is essentially the same concept as the approach of having the LED emit at different wavelengths, except instead of using two different wavelengths, two different modulation frequencies can be used, and the addition of photosensor #3 is not necessary.

As an example, and with continued reference to FIG. 4, assume that the brightness of LED #1 is modulated sinusoidally at a frequency of 200 kHz, and LED #2 is similarly modulated at 300 kHz. Upon receiving the signal from the photosensor, the two frequencies can be demodulated separately to obtain the ratio of the amplitudes of the two frequencies, which can then be converted to a voltage signal representing the position of the string. Any other variation on this concept can be used, and two or more could be used in concert if desired. For example, two different wavelength LEDs and two wavelength-selective photosensors could be used, and the two LEDs can also be modulated at two different super-sonic frequencies, etc. In addition, if spectral patterning were to be used from a small source such that the illumination wavelength varied continuously as a function of position of the string, and if a spectrally sensitive detector were used instead of a standard photosensor, then the same approach would work as described in FIG. 1.

Figure 5:
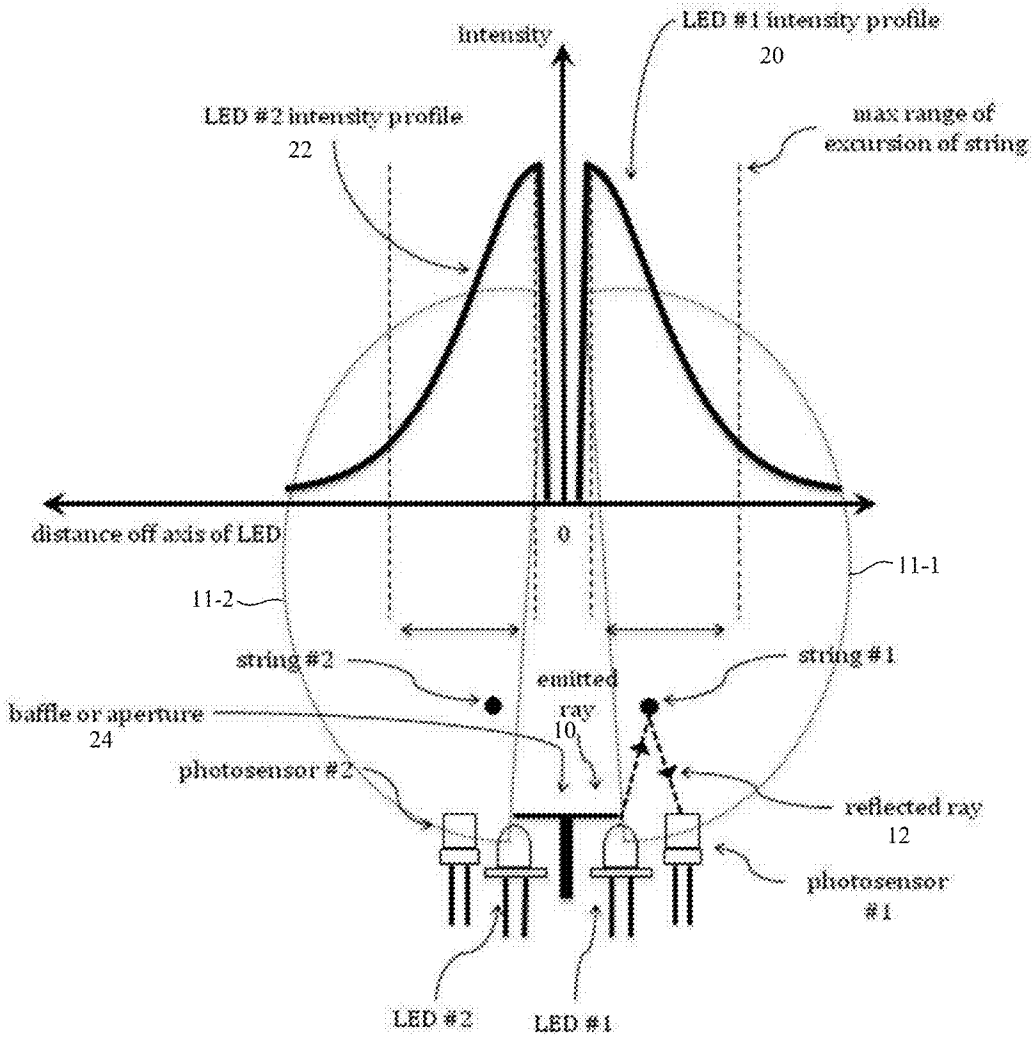
FIG. 5 illustrates an optical framework for a representative optoelectronic pickup and a diagram showing how an optoelectronic pickup measures the position of a guitar string in the horizontal direction using a multiplicity of LEDs and a baffle or aperture structure that precludes unwanted crosstalk between reflections of two or more strings into any of the photosensors in accordance with various embodiments.

It is not necessary, and in some cases not desirable or practical, to use a single LED to illuminate two strings simultaneously. As an example, if the pickup were to be designed for use on an acoustic bass, the strings would be too far apart to practically use a single LED between each pair of strings. In this case, one or more LEDs can be used for each string, and all the above options for transducing the string position apply. With reference to FIG. 5, it may be necessary or desirable to block or baffle a portion of the light from each LED, or differently focus or otherwise filter or shape the light in these cases, so as to ensure that each LED illuminates only the desired string, and there is no unwanted crosstalk between reflections of two or more strings into any of the sensors. A representative configuration of a baffle or aperture structure 24 is depicted in FIG. 5.

By way of further example, and in accordance with some embodiments, an optoelectronic pickup of a stringed instrument includes two LEDs positioned to direct light to impinge a single string, and two photosensors positioned relative to the two LEDs to detect reflected light from the single string. The pickup uses a differential signal from the two photosensors to produce an output signal during play. This differential signal can be used for other purposes in addition to producing string sound during play.

As LEDs become more varied, brighter, and available in more shapes, sizes and packages, many other possible configurations for the illuminator become practical, and these may have advantages for different versions of the pickup, depending on application. By way of example, it may be possible to use an array of LEDs to illuminate each string. By using an array, the beam pattern that impinges on the string could be controlled with much more detail, and could also be varied on demand, being controlled electronically by either analog electronics, or digital controls which would allow the beam pattern to be pre-programmed, then called up on demand by the user at any time. Since the waveform of the voltage signal delivered by the pickup as a function of string position depends on the beam pattern at the plane of the strings, the tone of the pickup can be changed significantly by changing the beam pattern of the illuminators. If an individual array of micro LEDs is used to provide illumination for each string, then the tone of each string could be controlled independently by adjusting its illumination pattern. Many other configurations of LEDs and associated optics which affect the illumination pattern are contemplated to affect the sound of the pickup, improve its performance for particular instruments, and reduce power consumption.

The illumination can be shaped in other ways using various optical components and filters so as to change the tone of the pickup. Specially shaped lenses, perhaps with complex shapes, can be designed and produced in quantity inexpensively using injection molding. These lenses can be used to shape and direct the output of the illuminator LEDs as needed. Diffractive optics, such as Fresnel lenses or holographically produced gratings with very complex patterns can be designed, and also produced at low cost. Simple baffles and apertures can be used, as well as absorbing filters with complex patterns can also be used to shape the beam profile at the string plane. Some or all of these and other optical components can be used together in whatever combination is necessary to achieve the desired result, and in many cases, they can be combined into a single component to reduce cost, and ensure proper alignment.

As an example, a diffractive lens can be formed into one side of a clear plastic element which also has special shaping to function simultaneously as a refractive lens in order to further shape the beam. Another example is a plate containing both apertures of specific shapes and absorbing features with varying patterns across the aperture. Also, since LEDs are typically packaged in a transparent or translucent cast or molded plastic capsule, and usually a lens is integrated into this plastic capsule, special optics for beam shaping may be incorporated into the LED package as well. This may again include refractive, diffractive, absorbing and baffling elements, depending on what is needed, and what is practical to include into the LED manufacturing process. Custom packages for LEDs are becoming more common, and it is often not costly to have special forms made and used by the LED manufacturers in order to obtain LEDs with highly specialized packaging.

Since an optoelectronic pickup depends on reflected light from the sound producing element(s) of the musical instrument (e.g., strings), one or more features can be applied to, or incorporate into, the sound producing element(s) to enhance the optical sensing capability of the optoelectronic pickup. For example, one or more characteristics of the sound produced by an optoelectronic pickup implemented for a string instrument can be affected, enhanced, and/or tuned by the use of special "optical strings." Optical strings for a guitar or other instrument, for example, preferably have special finishes or geometries that better reflect the light, or scatter the light in desirable way in order to achieve a desired effect. The special finish may be applied only to the portion of the string that is illuminated by the LEDs, or to the whole string.

Figure 6:
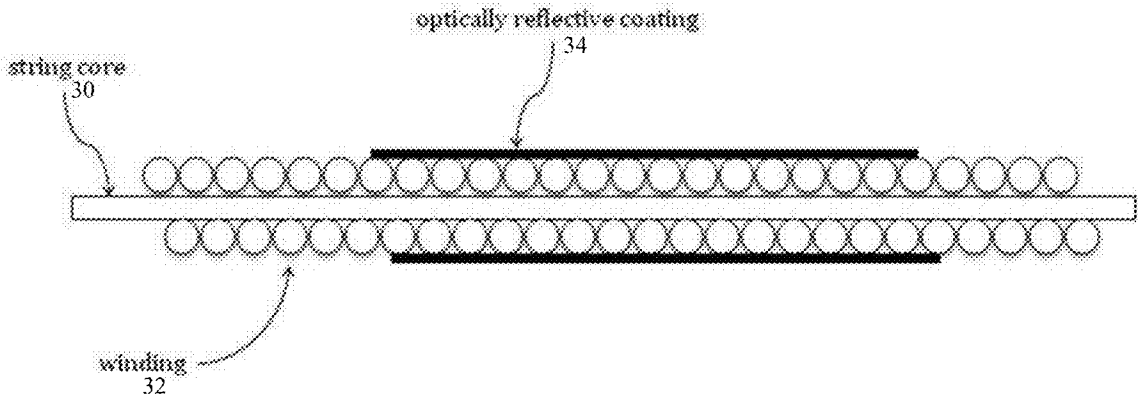
FIG. 6 shows a diagram of an optical string having an optically reflective coating provided over a portion of the string windings in accordance with various embodiments.
Figure 6A:
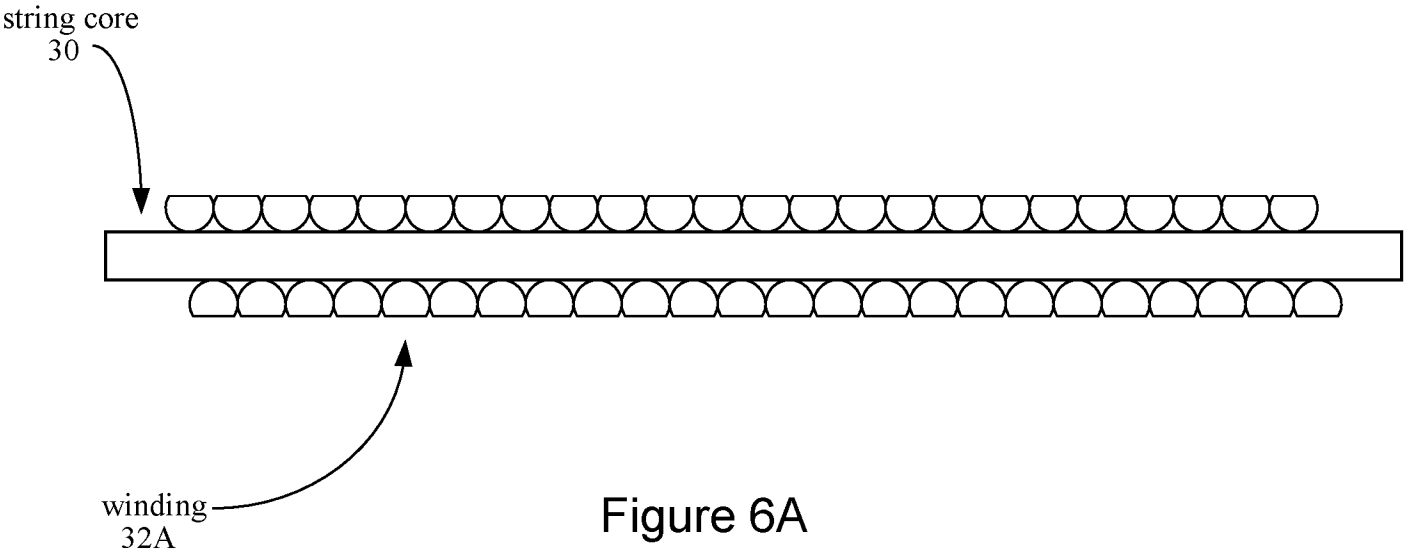
FIG. 6A shows a diagram of an optical string in accordance with other embodiments.

For example, and with reference to FIG. 6, most guitar strings have windings 32 on the three heaviest strings, and these windings are usually "round-wound," meaning that the winding wire has a circular cross section. However "flat-wound" strings can be used to enhance optical sensing, as is shown in FIG. 6A, which have either windings 32A with a rectangular cross section, or they may be round-wound strings with the outer surface polished to a flat finish (e.g., "half-round" strings). The type of winding does affect the tone, however.

Light reflects better from smooth surfaces, so it can be advantageous (but not necessary) to have all or part of the string flat wound. However, to maintain a particular tone, it may be desirable to have only a portion of the string polished flat to better reflect the light. Other types of special finishes, or partial finishes (only a small portion of the string modified) may be used as well. For example, the illuminated portion of a round-wound string may be partially polished to leave flattened surfaces on the round windings, but not polished all the way so as to make the surface completely flat.

In addition to special polishing or winding types, special coatings may be used. These coatings may be applied to all or part of the string, and can be used to achieve similar results to the polishing. For example, a small section of a round-wound string may be coated with a material that fills in the tiny valleys between the windings in the illuminated region of the string so that it effectively has a smooth surface, and therefore reflects the light better. A diagram of such a coated string is shown in FIG. 6, which is shown to include a string core 30, windings 32, and an optically reflective coating 34 provided over a portion of the string windings 32. Many variations on these concepts for special optical strings are contemplated.

Since the optoelectronic pickup also allows the use of non-ferro-metal strings, there are many more options that become available for tuning the tone of the instrument by use of different strings or special string sets. Most any material can work, as long as it has desirable properties as a string, so special strings can be fabricated to provide a wide variety of tonal options, as well as other properties, such as greater ease in stretching or "bending" the strings. In addition, special string sets can be made and sold as optimized for certain styles of music or playing technique. For example, standard metal wound strings may be used as the three lowest strings to maintain the sharpness of tone in the low registers, while nylon strings may be used as the three high, non-wound strings to provide a softer, mellower tone in the high registers. This may, for example, be appreciated by jazz players for certain compositions. There are many string materials and many combinations of string type that can be used to create special string sets specifically for use with optoelectronic pickups of the disclosure.

As previously discussed, an optical instrument pickup of the disclosure is essentially a position sensor which can transduce the position of an instrument string, and, as such, it is able to measure motion all the way down to zero frequency, meaning that a DC signal is produced in response to the static location of the string. If the string is vibrating, the waveform of the motion will be centered around its current location, so if the string is offset from its normal resting position, the waveform will be DC shifted according to its offset resting position. Low-frequency information below the audio frequency range (anything below about 20 Hz or so) is not wanted in the audio signal path, and so is filtered out electronically. However, this very low frequency information need not be discarded, and can instead be used as a control signal.

It is extremely common for guitarists to "bend" strings while playing, which means that they push or pull one or more strings upward or downward across the neck while playing a note. This allows them to introduce musically expressive pitch shifting of the notes as they play. Since the optoelectronic pickup affords the player a great deal of control over volumes, tones, and other effects (such as tremolo) that is not provided by magnetic pickups, and has the electronics to support this control, if the information of the string position is separated from the audio path into an independent control channel, it can be used to change any individual parameter, or combination of parameters of the sound during play in concert with the bending of a string.

For example, the "average" string position obtained from this low-frequency signal could be used to add a tremolo effect to the sound as the string is bent upward; the farther the string is bent, the more strongly the tremolo is applied to the note. The average string position information can be used to increase the volume of a string in response to its being bent, or dynamically change the tone in some way. It is also possible to also send this control signal out of the pickup to outboard electronics that are being used to enhance the sound of the instrument, or even to affect the sound of another source. In most cases with modern musical electronics, these devices are controlled via MIDI, but some (such as classic analog synthesizers) still use simple control voltages. The support electronics can be provided in the pickup itself, or via an outboard device, to convert the control signal into MIDI data for use in controlling outboard devices such as most modern multi-effects processors.

In some embodiments of the present disclosure, an optoelectronic pickup includes individual sensors that measure the motion of each string separately. This makes possible a number of things that are not available with standard magnetic pickups. The optoelectronic pickup can provide separate channels for the sound of each string, which allows each sound to be processed and modified separately, or can allow the creation of a stereo instrument sound in which the sounds from each string are panned into a particular location in the stereo field.

Having separate channels for each string also allows the creation of a MIDI instrument. This means that the information about which string is being played, the note being played on that string, and any other information, such as the positional control signal described above, will be digitized, and delivered on the MIDI bus. Once this is done, it can be used to control many common electronic instruments and audio devices such as synthesizers, and effects processors. It can also be used to interface with a computer, and be used with special software to function as a teaching tool that monitors the players actions in real time. This same system can be used to create a computer game similar to those such as GUITAR HERO®, which allow the player to test his/her skill against a simulation of the real thing, except in this case using a real guitar, not a specialized gaming controller.

Figure 7:
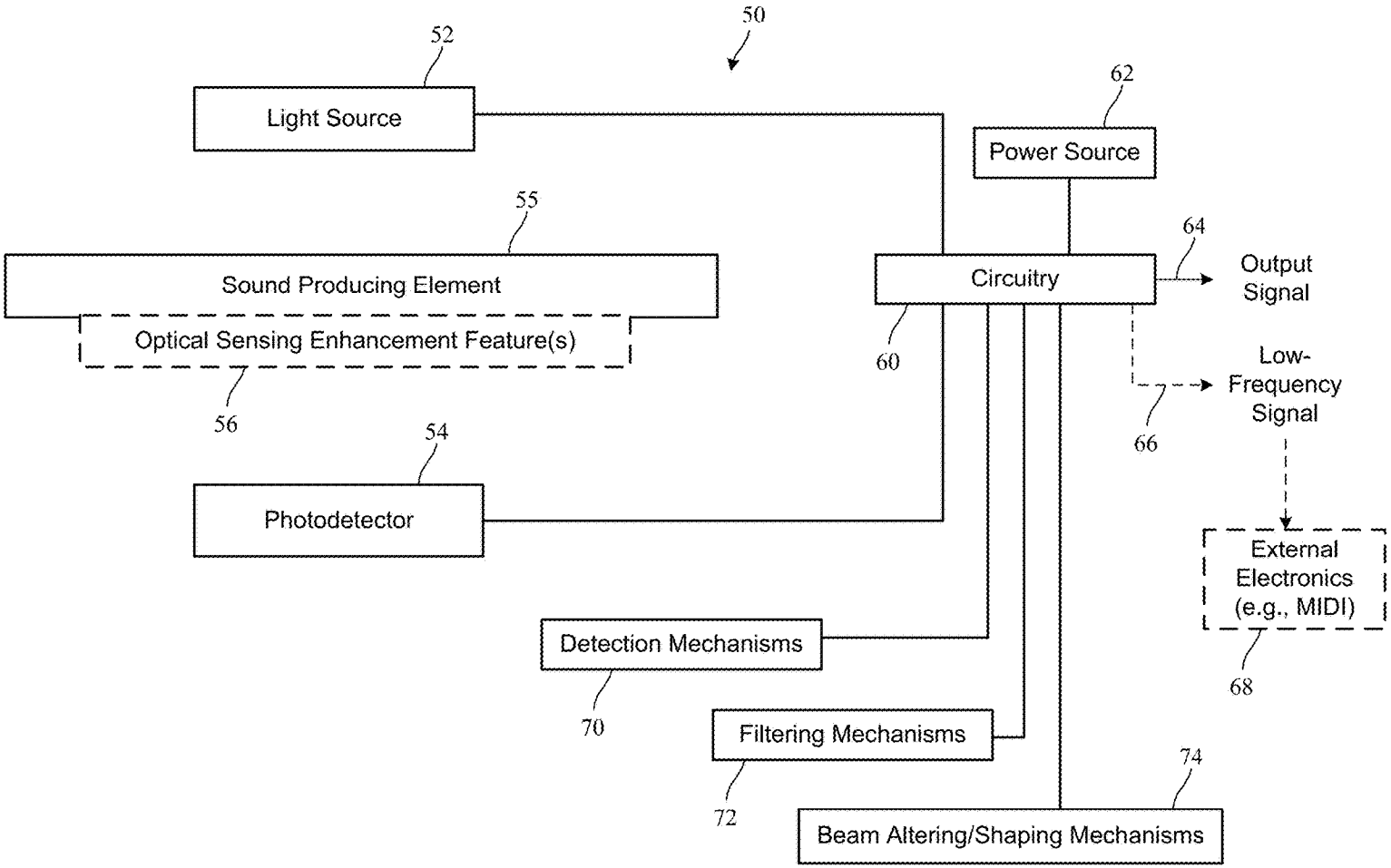
FIG. 7 is a diagram of an optoelectronic pickup in accordance with various embodiments.

FIG. 7 is a diagram of an optoelectronic pickup 50 in accordance with various embodiments of the disclosure. FIG. 7 shows a number of different components of the optoelectronic pickup 50, some or all of which can be incorporated into an optoelectronic pickup implementation depending on the particulars of a given application. The optoelectronic pickup 50 shown in FIG. 7 includes a light source 52 and a photodetector 54 that cooperate to impinge light on, and sense light reflection from, a sound producing element 55 or elements of a musical instrument. One or more features (e.g., coatings, finishes, polishing, geometries) 56 can be applied to, or incorporated into, the sound producing element(s) 55 to enhance optical sensing of the pickup. Circuitry 60 is provided to control the light source 52, photodetectors 54, power source 62, and other analog and/or digital components of the optoelectronic pickup 50. Depending on the particular implementation, the circuitry 60 may include one or more detection mechanisms 70, filtering mechanisms 72, and/or light beam altering or shaping mechanisms 74. These mechanisms may include one or a combination of various structural, material, electrical/electronic, algorithmic, and optics/optical components. The circuitry 60 is configured to perform position measurements of the sound producing element(s) 55 and produce an electrical output signal 64 indicative of such position measurements during play. As discussed above, low-frequency components 66 of the signal 64 can be output from the circuitry 69 and communicated to one or more external electronic devices or systems, such as a MIDI device 68.

Various embodiments of the disclosure can incorporate one or a combination of the features described hereinbelow. For example, one or a combination of features described above can be incorporated in an optoelectronic pickup or optoelectronic pickup system which includes or combines one or more features described hereinbelow. It is understood that a wide variety of embodiments are contemplated which may include or exclude various features described herein and in commonly owned U.S. Pat. No. 7,977,566, which is incorporated herein by reference.

According to various embodiments, an optoelectronic pickup in accordance with the disclosure utilizes filtering to control the affects of spurious light. As used herein "spurious light" is defined as light energy that is directed toward a photoreceiver and is unrelated to a condition of an instrument string associated with the photoreceiver. There are a number of possible sources of spurious light. Stage lighting, room lighting and sunlight provide high intensity spurious light, but less intense surrounding light is also a concern. Another possible source is reception of light from an "unassociated" instrument string. While an exhaustive list of the sources is not intended, it should be noted that reflections will also occur from the fingers and/or the "pick" used in playing the instrument. The reflecting objects tend to have movements at a much lower frequency than the instrument string.

The resulting spurious light information can be removed using signal processing or analog electronic filtering techniques, but filtering of spurious light from other sources may be more easily or effectively accomplished using optical-based filters or structure-based filters, alone, or in combination with electronic filtering or processing techniques.

A number of dissimilar filter approaches are included to control affects of spurious light upon the electrical signal, where the spurious light is light energy that is directed toward a photoreceiver and that is unrelated to a condition of the instrument string. The dissimilar filter approaches of a particular embodiment may be taken from a single filter category or may be selected from different categories.

One filtering category includes those filter approaches that are implemented following the reflection of the light by the instrument string (i.e., the post-reflection approaches). A barrier may be placed between adjacent photoreceivers to block light reflected by one string from reaching a photoreceiver associated with a different string. An additional or alternative approach is to provide a stepped structure which limits the path to a photoreceiver. For example, the stepped structure may be a tube-shaped structure that is ribbed in a tiered fashion to defuse reflections of light from its walls, thereby reducing the capture of interfering light. A light filter may also be a barrier with a small slit, typically at its center to dictate the path of light to a photoreceiver. The light filter can be positioned to channel only light that is in line with its slit, thereby ensuring only the light collected by an optical lens, which may have its first and second foci located at the string and the slit, respectively, is allowed to fall upon the associated photoreceiver, thereby limiting the acceptance of light from distances and angles outside of the desired detection range. The optical lens may be a cylindrical lens. In addition to or as an alternative to employing barriers, the photoreceivers can be spaced at particular, irregular positions to better ensure reception of the "correct" reflected light. The photoreceivers and/or the light sources can be located in pairs adjacent to or offset from the positions of the strings of the musical instrument.

Filtering approaches may also be implemented post-reception of the optical signal. Room lighting typically includes modulation as a result of fluctuations in the alternating electric current which powers the room lamps. Spurious light typically falls upon all of the photoreceivers with generally equal intensity. The signals generated by adjacent photoreceivers may be inverted relative to each other. Then, when the signals are summed, the modulated room lighting can be cancelled. As an example, on a six-string guitar, three output signals from the photoreceivers will be "normal" and the remaining three will be "inverted," so as to allow reduction of the effect of interference.

Other filtering approaches may be considered to be a cooperation between light emission and light reception. Each light source may be modulated at a specific frequency that is higher than the highest audible frequency produced by the vibration of the musical string. As a consequence, the modulation frequency may be considered as the carrier upon which the string vibration signal is superimposed. Signal processing that is downstream of the associated photoreceiver can be configured to demodulate the received light signal so as to remove the carrier so as to filter spurious signals from outside light sources. Another approach is to tailor the optical bandwidths of the light source and the photoreceiver. Thus, the bandwidth of the photoreceiver may be tailored to preferentially pass the frequency spectrum of the light source.

Optical filters may also be placed across one or more of the light sources, thereby affecting the beam pattern of the emitted light and, in turn, the resulting sound. The optical filter may be a translucent plastic which diffuses the emitted light. A lenticular array may be employed to diffuse the light in one direction, but not the other. Optical filters may be created with a varying amount of absorption along their lengths or widths, thus causing the emitted light to have a pattern of greater and lesser intensities as desired at various locations in space. This variation in the illumination pattern at the plane of the strings changes the voltage signal that is indicative of the string vibration, so as to affect the tone or timbre of the sound produced by the instrument. A lens or multiple lenses may be added at the light sources to concentrate or shape the light. Optical filters at the light sources may also be structure based openings that channel the emitted light in a particular fashion, such as by narrowing the light in one direction.

An optoelectronic pickup of a string musical instrument in accordance with various approaches of the disclosure includes at least one light source configured to direct light to impinge an instrument string of the musical instrument, and at least one photoreceiver configured to detect light emitted by the at least one light source and reflected from the instrument string, the at least one photoreciever configured to generate an electrical signal using the detected light. A filter arrangement is coupled to one or both of the at least one light source and the at least one photoreceiver. The filter arrangement is configured to control affects of spurious light upon the electrical signal, the spurious light comprising light energy that impinges the photoreceiver and is unrelated to a condition of the instrument string.

The filter arrangement may comprise one or a combination of filter components. The one or combination of filter components can be configured to optically, electrically, or mechanically couple to one or both of the at least one light source and the at least one photoreceiver. For example, the filter arrangement may include signal processing circuitry coupled to the photoreceiver and configured to receive the electrical signal. The signal processing circuitry may be configured to electronically filter the electrical signal.

The filter arrangement may be configured to adjust optical bandwidths of the at least one light source and the at least one photoreceiver to preferentially pass a frequency spectrum of light emitted by the at least one light source. The filter arrangement may include a focusing lens in alignment with the at least one photoreceiver.

The filter arrangement may comprise a plurality of disparate filter components. Each of the disparate filter components can be configured to control affects of spurious light upon the electrical signal in a manner differing from other disparate filter components.

In other filtering approaches, the at least one light source is coupled to a modulator, and the modulator is configured to introduce modulation into light emitted by the at least one light source. The filter arrangement may include a demodulator coupled to the at least one photoreceiver and configured to remove affects of the modulation from the electrical signal.

In some filtering approaches, the optoelectronic pickup includes a plurality of the photoreceivers. One or more of the plurality of photoreceivers is associated with a disparate instrument string of the musical instrument. The photoreceivers are configured such that the electrical signal generated by a particular photoreceiver is inverted relative to the electrical signal of a photoreceiver adjacent to the particular photoreceiver. The filter arrangement may include circuitry configured to cancel the affects of the spurious light that is concurrently received by the particular and adjacent photoreceivers.

One or more of the plurality of light sources may include light emitting diodes. A structure may be configured to dictate a permissible light path to the at least one photoreceiver. The structure may include a light barrier positioned and dimensioned to substantially limit the light path to the photoreceiver to one in which the reflected light from the instrument string reaches the photoreceiver. For example, the light barrier may include a member having an opening to a lens which focuses the reflected light upon the photoreceiver. The structure may have a tubular shape and comprise internal ribs which inhibit internal reflections. The at least one photoreceiver may be offset to being directly aligned with the instrument string to accommodate a cone-shape projection of the light emitted by the light source.

In further approaches, the optoelectronic pickup can include an array of light sources arranged to direct light to impinge a plurality of the instrument strings, and an array of photoreceivers arranged to receive light resulting from reflection of the impinging light from the plurality of instrument strings. Each of the photoreceivers can generate an output signal indicative of intensity of light sensed by the respective photoreceivers. Signal processing circuitry is coupled to receive the output signals and configured to discriminate the light directed by the light sources and reflected by the instrument strings from other light sensed by the photoreceivers, wherein discrimination performed by the signal processing circuitry is based on at least one of frequency modulation and relative inversion of the output signals of adjacent photoreceivers in the array of photoreceivers.

In other approaches, the light sources are activated at a modulation frequency, and the signal processing circuitry comprises a demodulator configured to demodulate the outputs signals at the modulation frequency. In some approaches, the photoreceivers are arranged such that the output signals of adjacent photoreceivers in the array are inverted relative to one another, and the signal processing circuitry is configured to sum the inverted output signals of the adjacent photoreceivers to cancel common signal components. The light sources and the photoreceivers can have wavelength bandwidths that are generally tuned so as to be preferential with respect to a common band of wavelengths.

According to various approaches, the optoelectronic pickup is dimensioned to conform to a standard form factor that facilitates interchangeability of the optoelectronic pickup with pickups of other technologies that conform to the standard form factor.

As previously noted, a standard pickup creates a magnetic field and detects an instrument string as it vibrates in this field, thereby measuring the speed of the movement of the string. It then translates this signal into sound. While the configuration of a magnetic pickup is sufficient for sound production, it provides limited frequency content, and as such provides a limited sound. Furthermore, a magnetic pickup can be susceptible to magnetic damping, which can limit the duration of a particular sound (i.e., the "sustain" of the instrument). Conversely, the configuration of the pickup according to embodiments of the disclosure (herein referred to as "pickup 100") enables the detection of the position of an instrument string as it vibrates, thereby allowing pickup 100 to capture more frequency content and, thus, generate a more robust sound. This position information can be used as a control signal, allowing the musician another channel for expressive playing. Additionally, because pickup 100 does not employ a magnetic field, it is not susceptible to the interfering elements that can cause a magnetic pickup to produce a hum or buzz. Because pickup 100 senses string motion optically and captures more frequency content, it enables other features than can be used to modify the sound produced. As described below, pickup 100 can enable electronic control of individual string volume, tone, and other characteristics, and can employ optical filters to modify the signal, change the harmonic content, and the like, in order to allow a musician to create a "signature sound." Although the description herein generally describes pickup 100 as installed in an electric guitar, this is not to be construed as limiting, as embodiments of the disclosure can be implemented on any stringed musical instrument.

Unlike current optoelectronic pickup apparatuses, pickup 100 does not need to be installed into a musical instrument at the time of its manufacture. The design of pickup 100 allows it to be added to an existing instrument. That is, pickup 100 may be installed as a retrofit assembly. For example, a guitarist can replace the magnetic pickup of his guitar with pickup 100. Typical magnetic pickups are mounted below the strings and in one or more locations in the open center of the guitar body, between the end of the neck and the bridge. Magnetic pickups come in several form factors, but there are prevailing standard form factors for these pickups which enable interchangeability of one brand of pickup with another. Perhaps the most common and popular type of pickup is the "humbucker," which has two coils and rows of magnets and is constructed with a standardized form factor. Pickup 1 00 is fundamentally different from known optoelectronic pickups in that it can be specifically designed so that it can be packaged in the standard humbucker form factor, and as such pickup 100 can be mounted, positioned, and electrically wired into the guitar exactly as a typical magnetic humbucker. The technology of pickup 100 uses reflection-mode illumination and a unique optical illumination and sensing scheme that can allow it to work with a larger range of string motion and to reject interference caused by ambient light. In general, musicians are particular about the instruments they play, and the modular nature of pickup 100 allows a musician to, for example, enhance the sound of his current instrument, rather than replace it. This can be particularly advantageous if a musician uses an instrument of exceptional quality or one having a particularly desirable characteristic. Furthermore, pickup 100 can be added to acoustic instruments to enable them to produce sound electronically.

Figure 8:
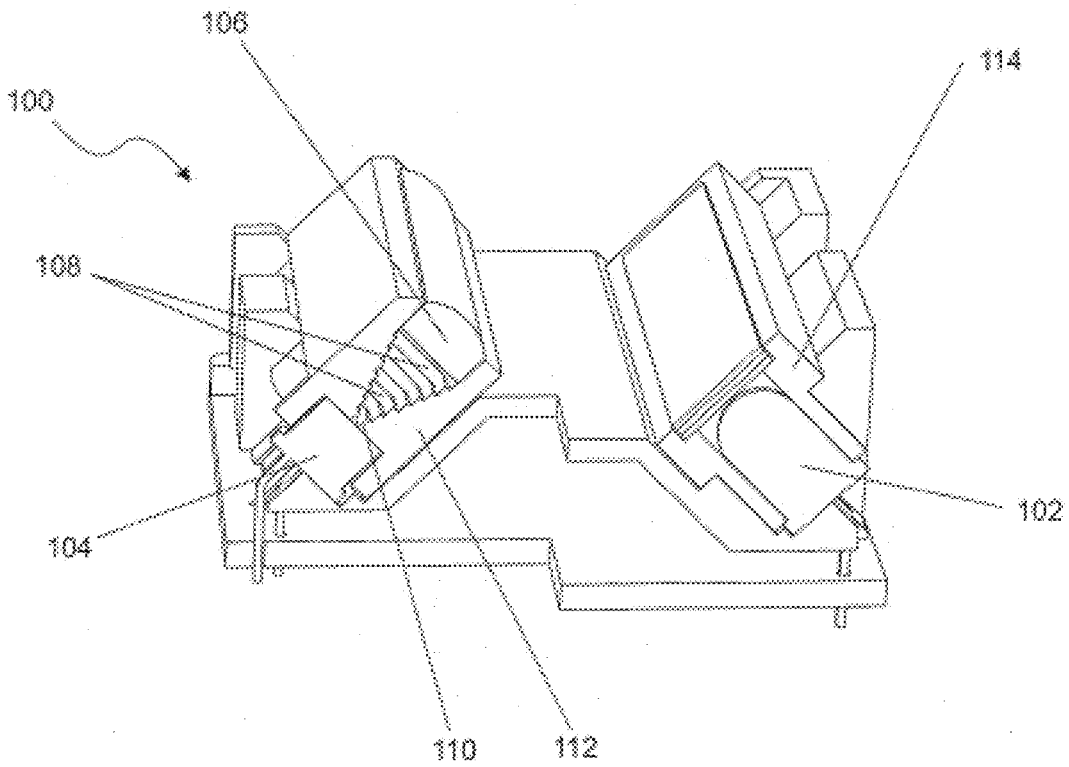
FIG. 8 illustrates an example of a perspective view of a cutaway section of an optical pickup in accordance with various embodiments.
Figure 9:
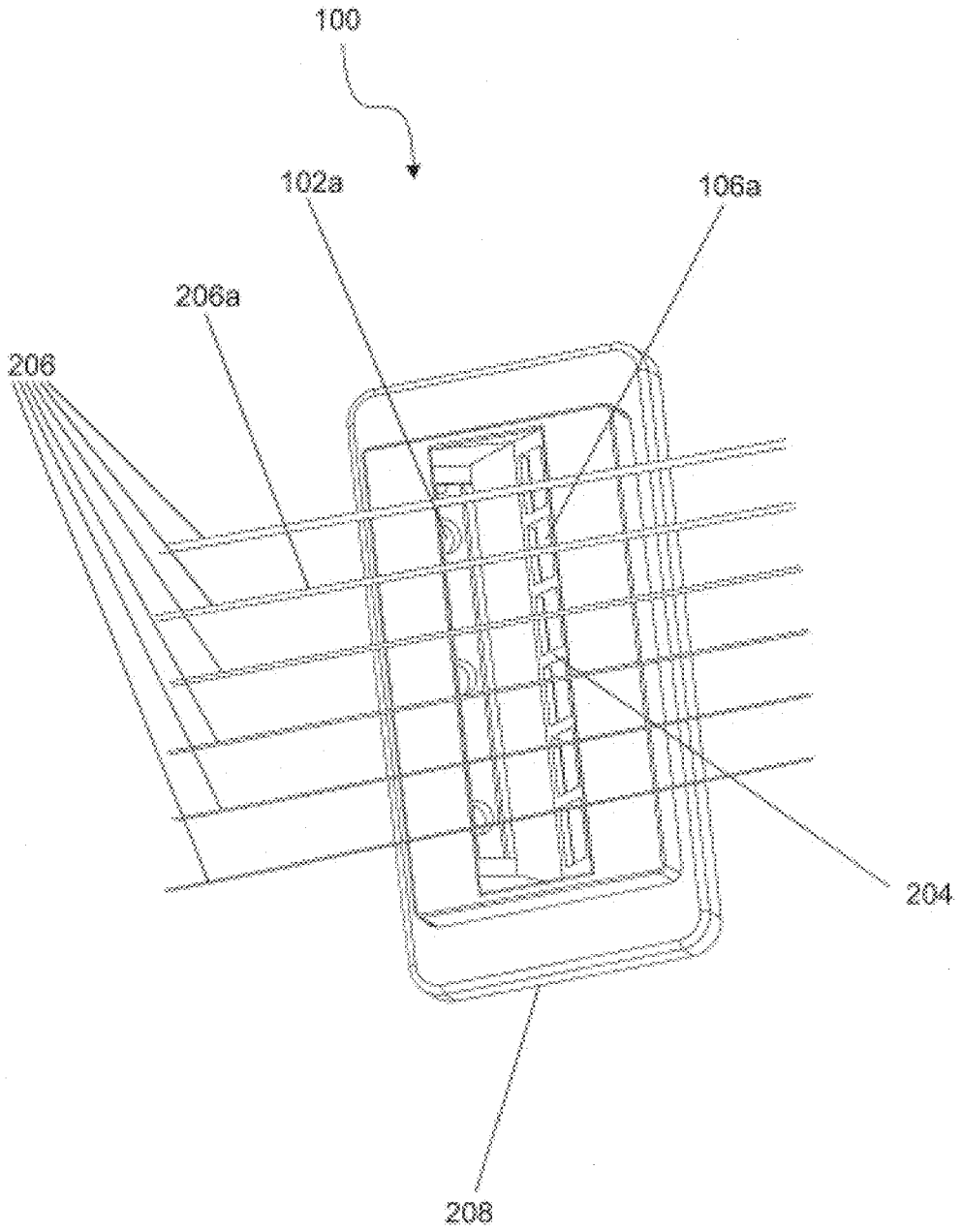
FIG. 9 illustrates an overhead view of the optical pickup of FIG. 8 as applied to an instrument having six strings in accordance with various embodiments.
Figure 11:
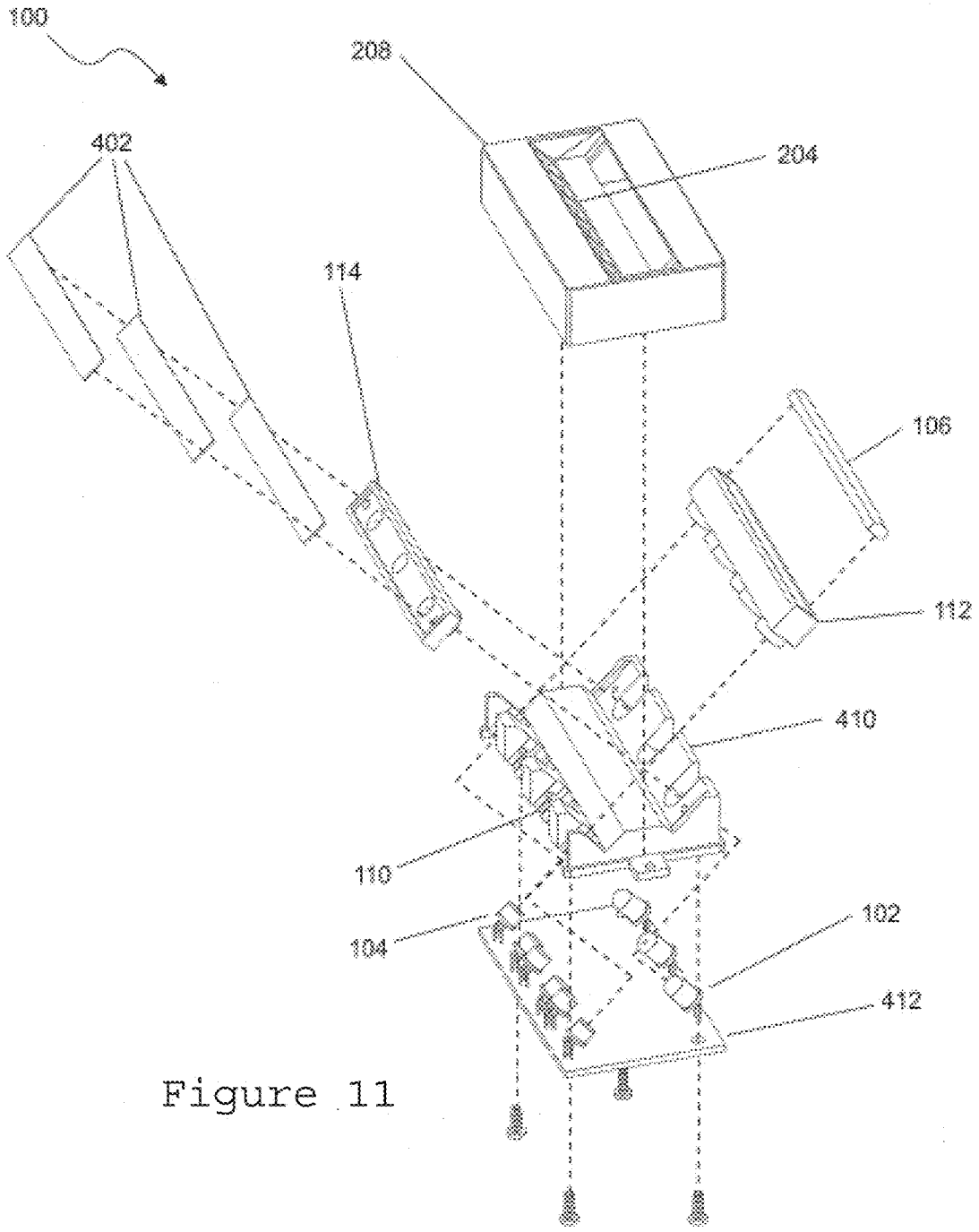
FIG. 11 illustrates an exploded view of the optical pickup shown in FIG. 8 in accordance with various embodiments.

FIG. 8 illustrates one possible embodiment of pickup 100. Pickup 100 can include one or more light sources 102. For example, as depicted in FIG. 9, pickup 100 can include three light sources 102. Each of the light sources 102 can be positioned in proximity to a pair of instrument strings 206. That is, there may be a two-to-one relationship of strings and light sources. In one embodiment, light source 102 can be an infrared, light-emitting diode (LED). For example, light source 102 can be a Gallium-Aluminum-Arsenide (GaAlAs) LED, such as one manufactured by Vishay Semiconductors, which emits light of a narrow wavelength bandwidth (e.g., centered around 870 nanometers). The light emitted from light source 102 can be projected as a cone, with the light brightest at its center and becoming gradually dimmer towards the exterior of the cone. As shown in FIG. 8, light source 102 can be positioned at an angle via illuminator flange 114 to ensure the light is effectively reflected from the instrument string(s) 206. For example, as shown in FIG. 11, light source 102 can be positioned via base 410 so that the light is emitted at a 45 degree angle and strikes instrument string 206 five to eight millimeters from light source 102.

Light source 102 can be positioned to project the middle of the cone of light between a pair of adjacent instrument strings 206, and as such the emitted light can be reflected off one or more instruments strings 206. For example, referring to FIG. 9, moving string 206*a* up will position it closer to the center of the cone of light emitted from light source 102*a*, and therefore into a region of brighter illumination resulting in more reflected light into lens 106*a*, and thus, into photosensor 104, in turn resulting in an increase in its voltage output. Moving string 206*a* down will cause it move away from the brightest region of light emitted from light source 102*a*, causing the voltage signal from photosensor 104 to decrease. Instrument string 206 can be a typical instrument string, as a typical instrument string can be composed of material that can enable a sufficient reflection. Alternatively, instrument string 206 can be composed of a specific material that can enable or enhance the functionality of pickup 100.

The reflected light can travel downwards, at an opposite angle relative to the light incident to the instrument string, towards one or more photosensors 104. Pickup 100 can include multiple photosensors 104 to enable the capture of light emitted from the light sources 102 and reflected off the instrument strings 206. As depicted by FIG. 11, pickup 100 can include one or more photosensors 104. Photosensor 104 can be positioned at an angle via base 410 to ensure that the light is captured accurately. The spacing of photosensor 104 can vary per implementation. In one embodiment, sensors 104 are evenly spaced in a row opposite a row of light sources 102 via receiver flange 112. A photosensor 104 can be associated with a particular instrument string 206, thereby enabling pickup 100 to create a sound for the particular instrument string 206 (i.e., there is a one-to-one relationship of photo sensors and instrument strings.) However, if photosensor 104 is misaligned, such as due to improper placement of pickup 100 on the instrument, photosensor 104 can receive the reflected light from the incorrect instrument string 206 (e.g., the adjacent string). A barrier 204 can be placed between one or more photosensors 104 to prevent photosensor 104 from receiving the reflected light from the wrong instrument string 206 by shielding photosensor 104 from the light reflected from other instrument strings 206. Thus, the barrier reduces or eliminates optical crosstalk. Barrier 204 can be included with pickup 100 during installation or can be added subsequently. For example, as shown in FIG. 11, barrier 204 can be integrated into a pickup cover 208.

In addition to, or instead of, employing barriers 204, photo sensors 104 can be spaced at particular, irregular positions to ensure reception of the correct reflected light. Photo sensors 104 can be located in pairs adjacent to the positions of the instrument strings 206. As aforementioned, the light emitted from a light source 102 can be reflected off instrument string 206 at a downward angle. As the light is emitted as a cone, the light reflected downward can also be cone-shaped. Placing photosensor 104 adjacent to the position of instrument string 206, rather than immediately beneath it, can ensure that the reflected cone-shaped light is captured by the appropriate photosensor 104 and not by a neighboring photosensor 104.

Figure 12:
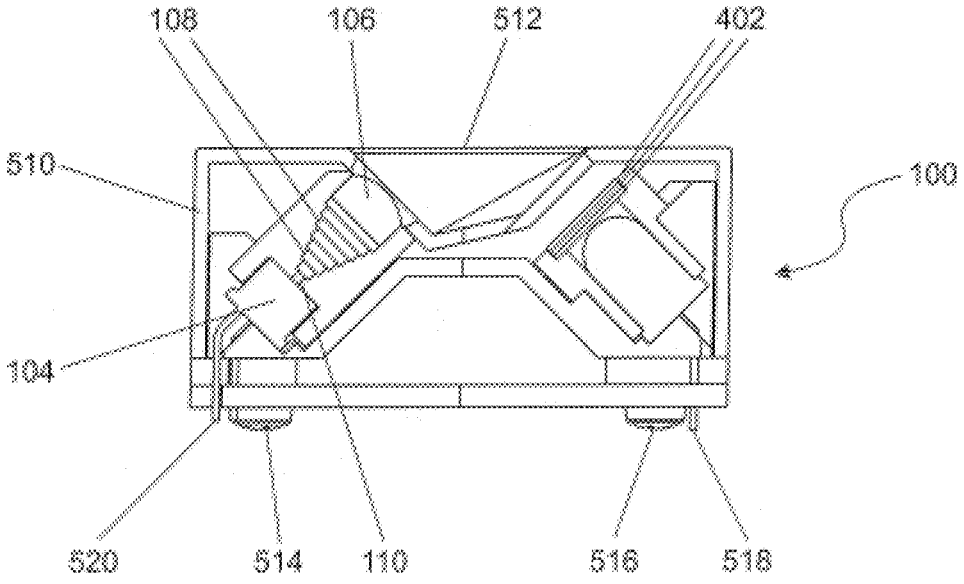
FIG. 12 illustrates a cutaway side view showing internal components of an optical pickup, the split-plane cutaway in this figure corresponding to that of FIG. 8 in accordance with various embodiments.

Pickup 100 can capture the light emitted from light source 102 via lens 106, stepped structure 108, light filter 110, and photosensor 104. As depicted in FIG. 8, lens 106 can be a single component (e.g., a single pane) incorporated across multiple photosensors 104. However, this is not to be construed as liming, as pickup 100 can include an individual lens 106 for each photosensor 104. If one or more barriers 204 are desired, barrier 204 can be affixed above or below the single lens component. Lens 106 can be a cylindrical lens and can capture the light reflected off instrument string 206 and can channel the light into stepped structure 108. A cylindrical lens ensures that the received light is focused only in one direction (i.e., towards photosensor 104). Stepped structure 108 can be a tube-shaped structure that is ribbed in a tiered fashion. One embodiment of a stepped structure is shown in FIG. 12. This design can allow stepped structure 108 to defuse reflections of light from the walls of its tube-shaped structure that did not originate from light source 102, thereby reducing the capture of interfering light. Therefore, stepped structure 108 can discriminately pass the emitted light to light filter 110. Light filter 110 can be a barrier with a small slit, typically at its center. Light filter 110 can be positioned to channel only light that is in line with its slit, thereby ensuring only the emitted light collected by lens 106 is allowed to fall on photosensor 104. For example, the emitted light can reflect off instrument string 206 on a horizontal plane and light filter 110 can block any light not on this plane. Stepped structure 108 and/or light filter 110 can be integrated with receiver flange 112. For example, receiver flange 112 can be a molded component designed to include a stepped structure 108 and light filter 110 for each photosensor 104. In other embodiments, stepped structure 108 and/or light filter 110 can be separate components or integrated with one or more other components.

Once the emitted light has passed through light filter 110, photosensor 104 can receive it. Photosensor 104 can be composed of one or more various materials. In one embodiment, photosensor 104 can be a diode composed of silicon, such as an NPN silicon phototransistor manufactured by Optek. Silicon diodes can sense light from a range of wavelengths. Alternatively, photosensor 104 can be a diode composed of GaAIAs, such as a GaAIAs diode manufactured by Opto Diode Corporation. A GaAIAs diode can be sensitive to a narrow range of wavelengths, enabling it to receive only the same narrow bandwidth of light emitted from a GaAIAs LED light source 102, and thereby significantly reducing interference from background light without reducing sensitivity to the light reflected from the strings. That is, the signal-to noise ratio is improved.

In order to further prevent interference from outside light sources, light source 102 can be modulated at a specific frequency higher than the highest audible frequency produced by the string vibration (e.g., 100 to 200 kilohertz). This can act as a carrier frequency onto which the string vibration signal will be superimposed. The electronics of pickup 100 behind photosensor 104 can be configured to demodulate the received light signal, removing the carrier, and preserving the vibration signal from the string. This enables pickup 100 to filter out all spurious signals from outside light sources (e.g., anything not at the carrier frequency of 100 to 500 kilohertz). The supporting electronics of pickup 100 can be affixed to circuit board 412. Additionally, the various components of pickup 100 can be mounted on circuit board 412.

Once the light is received by photosensor 104, the light can be analyzed to determine the position of instrument string 206 at the time of reflection, and this data can be employed to generate sound. The closer instrument string 206 is moved towards the center of the cone of light, the more light it reflects. As such, the signal becomes stronger and the associated voltage increases. Conversely, when instrument string 206 is moved away from light source 102, it moves farther from the center of the cone of light and the signal, and the associated voltage, decreases. As the strength of the signal varies per the position of instrument string 206 in the cone of light, the strength of the signal allows pickup 100 to determine the position of instrument string 206 as it vibrates. Because pickup 100 can generate sound based on the position of the instrument string 206, rather than solely on its vibration, pickup 100 can capture low frequency information that cannot be captured via a traditional pickup. For example, pickup 100 can capture a signal at zero frequency.

In addition to capturing the string vibrations by sensing the position of instrument string 206 as it moves in time, pickup 100 can produce a signal similar to a standard magnetic pickup by tailored filtering or by taking the derivative of the position signal (which is related to the speed of the vibrating instrument string 206) via analog or digital electronics. Instrument string 206 vibrates in three dimensions and the configuration of pickup 100 enables it to obtain a signal indicative of the position of instrument string 206 as it vibrates in three dimensions. Pickup 100 also does not have inherent filtering of harmonic content due to inductance as does a magnetic pickup. This allows pickup 100 to obtain a broad range of information about instrument string 206, thereby enabling pickup 100 to generate a more robust sound and provide harmonics not possible with a traditional pickup.

Optoelectronic pickups can be susceptible to interference caused by the modulation of external light sources. For example, the light emitted from room lamps can modulate due to fluctuations in the alternating electric current powering the lamps. Generally, light from room lamps may fall upon all sensors 104 fairly evenly, but the signals from the strings are independent, and their phase is not critical. The signals of one or more photosensors 104 can be inverted to reduce such interference. For example, on a six-string guitar, pickup 100 can be configured so that normal and inverted sensors signals alternate from one photo sensors 104 to the next (i.e., three photosensors signals are normal and three are inverted). When the normal and inverted signals are summed together, the modulated signal from the room lamps from the three inverted photosensors' signals can cancel out the signals from the three normal channels, thus reducing the effect of the interference. This is effectively an "optical humbucker." Even though the phase information of the vibration of the strings is not in general critical, in the preferred embodiment which uses a single light source 102 to illuminate two adjacent strings, the signals received from identical motion of the pair of adjacent strings would be exactly 180 degrees out of phase with each other due to the illumination scheme, when in fact they should be exactly in phase. Therefore, the inversion of adjacent pairs of photo sensors to form the optical humbucker, actually corrects for this phase difference.

As illustrated in FIG. 11, in one embodiment, pickup 100 can be designed to enable the use of one or more optical filters 402. Optical filter 402 can be placed across one or more light sources 102, thereby affecting how the light is emitted and, in turn, affecting the resulting sound. For example, one or more optical filters 402 can be affixed to illuminator flange 114. In addition to assisting with the positioning of light sources 102, illuminator flange 114 can enable the mounting of optical filters 402 and the like. Optical filter 402 can be transparent (or semitransparent) and can be constructed of metal, glass or plastic. For example, optical filter 402 can be a translucent pane of plastic that can be fitted over the light sources 102 shown in FIG. 9 to diffuse the emitted light. Optical filter 402 can be created with a varying amount of absorption along its length or width, thus causing the pattern of light emitted by one or more light sources 102 to be brighter or darker as desired at various locations in space. This can be used to create different illumination patterns at the plane of the strings, thereby changing the shape of the voltage signal produced as the string vibrates, and thus affecting the tone or timbre of the sound produced by the instrument. In another scenario, optical filter 402 need not be transparent and can include one or more openings that channel the emitted light in a particular fashion, such as by narrowing the light in one direction. For example, optical filter 402 can be designed to include one or more grooves that run its length. Alternatively, filter 402 can include a lenticular array that diffuses the emitted light in only one direction. In one embodiment, pickup 100 can enable the use of multiple optical filters 402 at once (as shown in FIGS. 11 and 12). For example, pickup 100 can allow optical filters 402 to be stacked upon another, with each optical filter 402 affecting the emitted light as it is channeled from one optical filter 402 to another, thereby allowing the player of the instrument to even further manipulate its sound. In another scenario, distinct optical filters 402 can be placed over one or more individual light sources 102. In an alternative embodiment, instead of, or in addition to, enabling the use of interchangeable optical filters 402, pickup 100 can include one or more integrated optical filters 402. In addition, one or more of the components 402 can be a lens, or array of lenses to either concentrate or spread the illuminating light in order to improve signal to noise, or produce other desirable sound characteristics.

Figure 10:
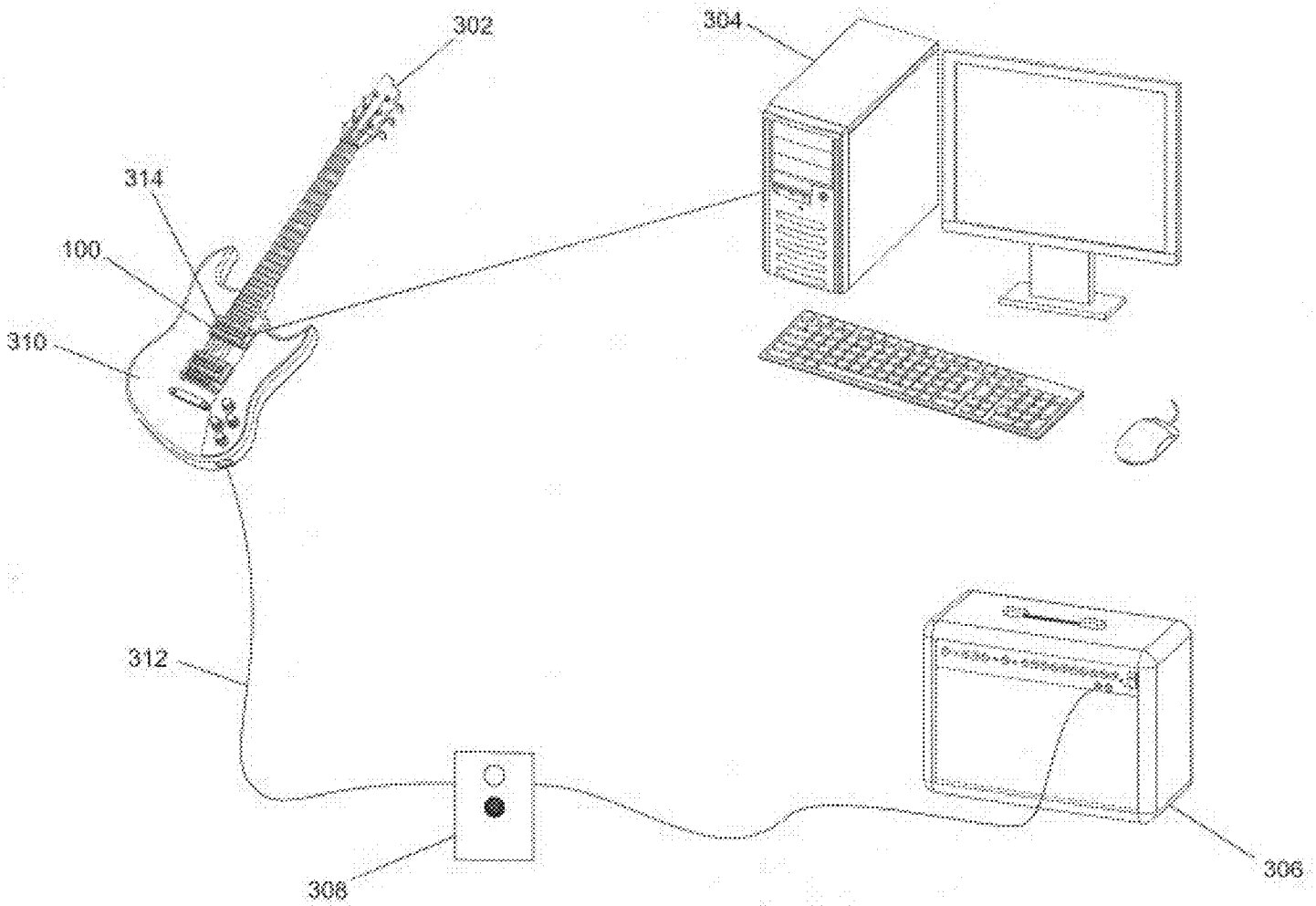
FIG. 10 illustrates a general architecture overview of a system for powering and/or interfacing with an optical pickup in accordance with various embodiments.

In addition to the aforementioned features, pickup 100 can include microprocessor 314 that can enable pickup 100 to be controlled and programmed. As depicted in FIG. 10, pickup 100 can also include an interface to allow pickup 100 to communicate with an external computer system 304, such as a personal computer, a mobile device (e.g., a personal digital assistant, an iPhone, a mobile phone, etc.), or specially designed remote control unit. For example, the remote control unit can be designed to resemble a remote control for a television set. Pickup 100 can include a wireless interface, such as an infrared or Bluetooth transmitter, and/or pickup 100 can include a wired data input/output interface, such as a universal serial bus (USB) port. External computer system 304 can be equipped with the proper interface and can employ software to interact with pickup 100 and allow a user to modify the configuration of pickup 100. A user can modify the sound of one or more instrument strings 206. For instance, the software may enable the user to individually control the volume of the strings, adjust the tone of an individual string, add an effect (e.g., vibrato) to the sound of a string, or the like. As another example, the sound of each instrument string 206 can be positioned in a stereo field. In one embodiment, an "optical vibrato" can be achieved by modulating the brightness of one or more of the light sources 102 via the supporting electronics in pickup 100 at a relatively low frequency (e.g., 0-50 Hz). Other modulations or tone variations can also be achieved by modulating the brightness of one or more of the light sources 102 at a high frequency (e.g., 50-20 k Hz) and with a particular modulation waveshape. The microprocessor unit 314 internal to pickup 100 can also store and retrieve settings made by the user. Therefore, various different settings programmed by the user, as described above, can be stored as "presets," and called up using one or more of the possible control methods, allowing the user to change the sound of the instrument between songs or performances, or during a song or performance.

Various mechanisms can be employed to power pickup 100. In one scenario, pickup 100 can be powered by battery 310, which can be included with pickup 100 or included separately on the instrument 302. Battery 310 can be rechargeable or replaceable. Alternatively, or additionally, pickup 100 can be powered by an external power source. In addition to powering pickup 100 itself, an external power source can serve to recharge battery 310. In one embodiment, the external power source can be powering device 308. Powering device 308 can serve as an intermediary, transmitting a sound signal received from pickup 100 via cable 312 to amplifier 306 while also conducting power to pickup 100 via cable 312. Powering device 308 itself can be battery-powered and/or can be connected to an external power source. Powering device 308 can be a multi-purpose device. For example, powering device 308 can provide functionality similar to a guitar effects pedal and can have the same form factor as a typical guitar effects pedal. Cable 312 can enable the transmission of a sound signal from pickup 100 while also transmitting power to pickup 100 from powering device 308. In one scenario, cable 312 can be a tip, ring, and sleeve (TRS) cable, thereby including three conductors. For example, the tip may conduct the sound signal to powering device 308, the ring may conduct the power to pickup 100, and the sleeve may serve as the ground connection. Alternatively, cable 312 can be a two conductor cable, such as standard electronic guitar cable, and pickup 100 and/or the powering device 308 can include a mechanism to enable the receipt and/or transmission of a power signal.

FIG. 12 illustrates an embodiment in which the optical components of the pickup 110 are in a self-contained unit. A housing 510 is formed of a material to block light other than through a transparent top window 512. This window is not necessary, but may be desirable to protect the critical optical components below. In use, the window is positioned below the associated instrument string. Fasteners 514 and 516 secure the printed circuit board, to the housing. While the side view of FIG. 12 shows only one light source 102 and one photoreceiver 104, there typically is an array of light sources and photoreceivers. Similarly, only two electrical leads 518 and 520 are shown. Conventionally, two electrical leads 518 are provided to power each light source and two electrical leads 520 are used to channel electrical signals from each photoreceiver.

Figure 13:
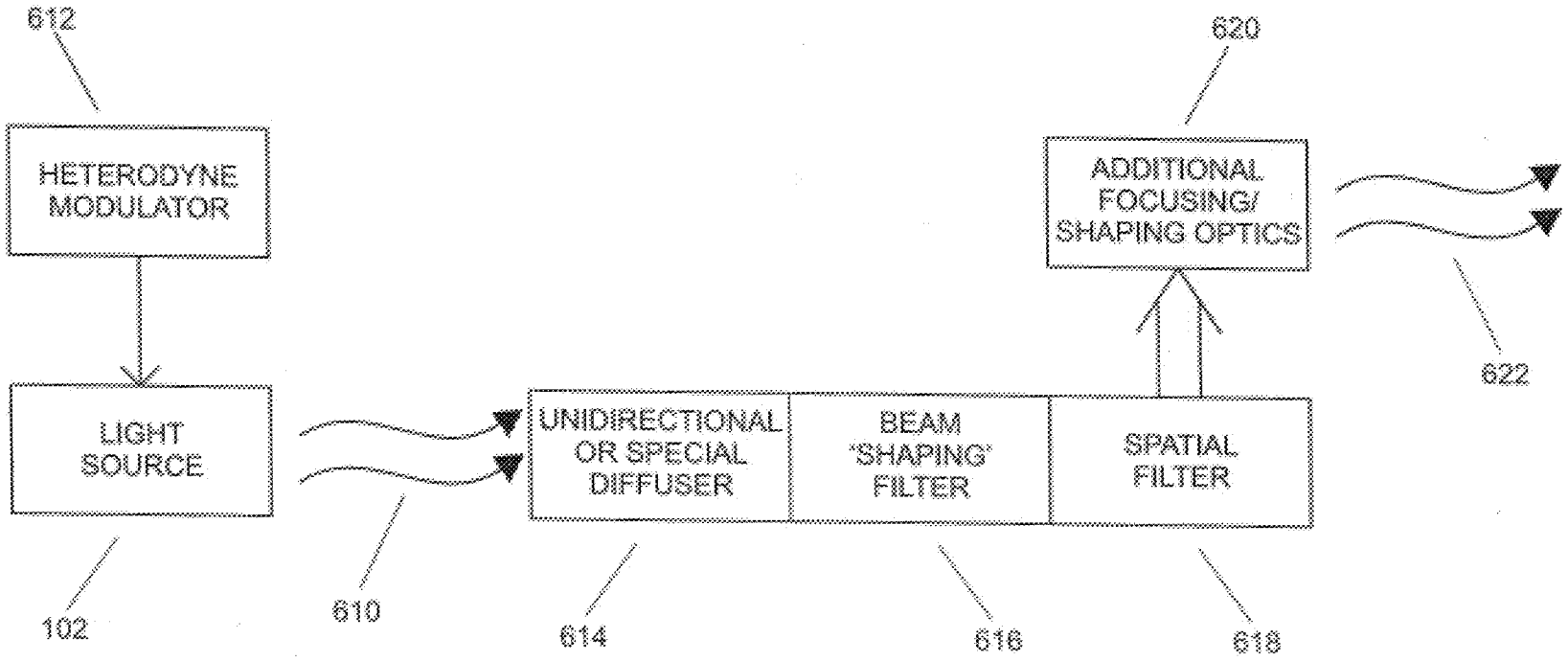
FIG. 13 is a block diagram of pre-reflection components relevant to filtering spacious light in accordance with various embodiments.

FIG. 13 is a block diagram of the "pre-reflection" components described below. That is, they are possible components for determining the characteristics of light that is directed toward the instrument string for reflection. The light source 102 described above generates light 610. With respect to filtering spurious light, there are two characteristics of the light energy that may be utilized. Firstly, there may be a matching of the frequency of the light with the bandwidth of the photoreceiver that is used to detect reflections from the instrument string. This matching was previously described. Secondly, a heterodyne modular 612 may be used to provide modulation at a specific frequency that is higher than the highest audible frequency produced by the vibration of the instrument string. As a consequence, the modulation frequency can be considered as the carrier upon which the string vibration signal is superimposed. Signal processing that is downstream of the associated photoreceiver can then be configured to demodulate the received light signal so as to remove the carrier, thereby filtering spurious signals from exterior light sources.

The light 610 may past through anyone or more of a diffuser 614, a beam "shaping" filter 616, and a spatial filter 618. These three components are shown as connected boxes, because a single component may be employed to provide all four functions. However, it is not necessary to have all of these functions. The diffuser may be unidirectional. That is, an optical filter may be provided to diffuse the light in one direction, but not the other. A lenticular array functions well. The beam "shaping" filter may be one or more lenses that are used at the light source side in order to concentrate or shape the light. As previously noted, distinct optical filters may be placed over one or more individual light sources in order to achieved desired results. The spatial filter may be structure-based, such as one or more openings that channel the emitted light 610 in a particular fashion, such as by narrowing the light in one direction. For example, the beam shaping and spatial filtering functions may be performed by providing an optical filter that is designed to include one or more grooves that run along its entire length. Other optical filters may also be used instead of, or in addition to those described above, and any of these filters may be changed in order to create a unique sound or special sound effect if desired.

Figure 14:
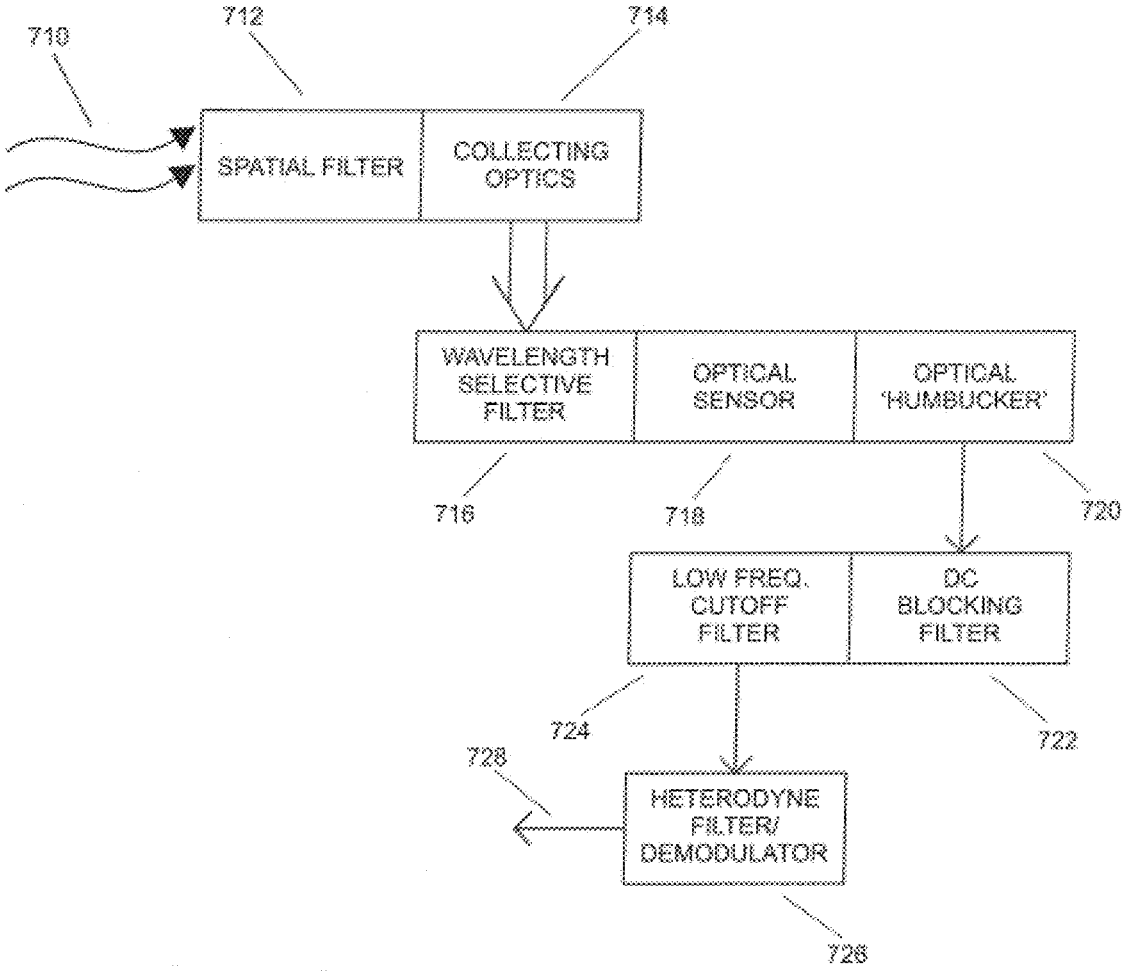
FIG. 14 is a block diagram of post-reflection components relevant to filtering spacious light in accordance with various embodiments.

Focusing/shaping optics 620 may be included to be specific to filtering at the receiver end. That is, this structure may be specific to special filters at the post-reflection side (i.e., the side dedicated to reception of the light following reflection from the instrument string). Light 622 from the optics is directed toward the anticipated petition of the instrument string. FIG. 14 illustrates the possible arrangement of components at the post-reflection side. Components which may be isolated or combined are shown in the same level of the four-level arrangement of FIG. 14. For example, the spatial filter 712 and the collecting optics 714 may be a single component that provides both functions. Alternatively, the two functions are provided by different components. Spatial filtering may be achieved by barriers placed between the photosensors described above. The barriers are positioned to reduce the likelihood that a photosensor will receive reflected light from an unassociated instrument string. The collecting optics may be the cylindrical lens 106 shown in FIG. 12.

At the next level of FIG. 14, a wavelength selective filter 716 precedes the photosensor 718. While the first level manipulates the "raw optical information", the second level provides manipulation of the optical information. The wavelength selected filter may be cooperative with the focusing/shaping optics 620 of FIG. 13 to pass only a desired range of wavelengths, or may be incorporated in the properties of photosensor itself as previously described The photosensor converts the optical information to electrical signals. An optical humbucker 720 has been described above as having an embodiment in which signals from a pair of adjacent photosensors are inverted. Then, when the normal and inverted signals are summed, the common-mode component of the modulated received signal that comes from room lighting entering the pair of photosensors will cancel out, suppressing the spurious light signals, and reducing the interference from external light sources.

At a next level a DC blocking filter 722 and a low frequency cutoff filter 724 provide processing to remove unwanted low-frequency information including non-modulated external light, and occasional reflected light from the player's fingers or pick. Then, a heterodyne filter-demodulator 726 functions to remove the modulation introduced by the modulator 612 of FIG. 13. The output 728 is introduced to conventional circuitry, such as an amplifier.

While embodiments of the disclosure are well suited for use with an electric guitar, such embodiments are not limited to such applications. The optoelectronic pickup may be used with any string instrument, such as metal string acoustic guitars, non-metal string guitars, violins, cello, acoustic basses, and even some percussion instruments, such as xylophones and an optical drum microphone. It is also possible to utilize the pickup with additional sensor elements which are sensitive to instrument body vibrations in addition to the string vibrations, so as to combine them to produce a richer, more adjustable tone. As another possibility, the motions of non-music-related vibrating elements may be sensed and measured.

What is claimed is:

1. An apparatus for use with a musical instrument, comprising:

at least one string comprising a treated section configured to enhance optical sensing of the string; and an optoelectronic pickup comprising:

at least one light source positioned to direct light to impinge the treated section of the string; and at least one photoreceiver positioned relative to the at least one light source to detect reflected light from the treated section of the string.

2. The apparatus of claim 1, wherein the treated section of the string has a smoothness that enhances optical sensing of the string.

3. The apparatus of claim 1, wherein the treated section of the string comprises a finish that enhances optical sensing of the string.

4. The apparatus of claim 1, wherein the treated section of the string comprises a coating that enhances optical sensing of the string.

5. The apparatus of claim 1, wherein the treated section of the string comprises polishing that enhances optical sensing of the string.

6. The apparatus of claim 1, wherein:

the string comprises a core and windings around the core; and the treated section of the string comprises an optically reflective material that fills in valleys between windings.

7. The apparatus of claim 1, wherein the treated section of the string has a geometry that enhances optical sensing of the string.

8. The apparatus of claim 1, wherein the treated section of the string has a cross-sectional geometry other than a circular cross-sectional geometry.

9. The apparatus of claim 1, wherein the string comprises a wound string having flattened surfaces at least in the treated section.

10. The apparatus of claim 1, wherein:

the string comprises a wound string having a round cross-section; and at least a portion of the treated section of the wound string is polished to a flat finish.

11. The apparatus of claim 1, wherein the string comprises a non-metal string.

12. The apparatus of claim 1, wherein the pickup is configured to measure a position of the treated section of the string.

13. The apparatus of claim 1, wherein the pickup is configured to measure a position of the treated section of the string using a characteristic of a beam pattern produced by the at least one light source.

14. An apparatus for use with a musical instrument, comprising:

one or more strings each comprising a treated section configured to enhance optical sensing of the one or more strings; and an optoelectronic pickup comprising:

a plurality of light sources positioned to direct light to impinge the treated section of the one or more strings; and at least one photoreceiver positioned relative to the plurality of light sources to detect reflected light from the treated section of the one or more strings.

15. The apparatus of claim 14, wherein the treated section has one of a smoothness, a finish, a coating or a polishing that enhances optical sensing of the one or more strings.

16. The apparatus of claim 14, wherein:

at least some of the strings comprise a core and windings around the core; and the treated section comprises an optically reflective material that fills in valleys between windings.

17. The apparatus of claim 14, wherein the treated section has a geometry that enhances optical sensing of the one or more strings.

18. The apparatus of claim 14, wherein at least some of the strings comprise wound strings having flattened surfaces at least in the treated section.

19. The apparatus of claim 14, wherein at least some of the one or more strings comprise non-metal strings.

20. The apparatus of claim 14, wherein the pickup is configured to measure a position of the treated section of the one or more strings.

* * * * *